US008588674B2

(12) United States Patent
Nanayama

(10) Patent No.: US 8,588,674 B2
(45) Date of Patent: Nov. 19, 2013

(54) IMAGE-FORMING APPARATUS AND METHOD FOR CONTROLLING IMAGE-FORMING APPARATUS

(75) Inventor: Daisuke Nanayama, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 309 days.

(21) Appl. No.: 12/980,038

(22) Filed: Dec. 28, 2010

(65) Prior Publication Data

US 2011/0182642 A1 Jul. 28, 2011

(30) Foreign Application Priority Data

Jan. 27, 2010 (JP) ..... 2010-015157
Oct. 8, 2010 (JP) ..... 2010-229090

(51) Int. Cl.
*G03G 15/00* (2006.01)
*G03G 21/00* (2006.01)
*B65H 29/70* (2006.01)

(52) U.S. Cl.
USPC ..... 399/406; 271/188

(58) Field of Classification Search
CPC ..... G03G 15/00; G03G 21/00; B65H 29/70
USPC ..... 399/406; 271/188
See application file for complete search history.

(56) References Cited

U.S. PATENT DOCUMENTS 5,084,731 A * 1/1992 Baruch ..... 399/406
5,392,106 A * 2/1995 Bigenwald et al. ..... 399/406
5,414,503 A * 5/1995 Siegel et al. ..... 399/406
5,761,600 A * 6/1998 Murata ..... 399/403
5,787,331 A * 7/1998 Ohkuma et al. ..... 399/406
5,933,698 A * 8/1999 Muramatsu ..... 399/406
6,002,913 A * 12/1999 Pawlik et al. ..... 399/406
6,259,888 B1 * 7/2001 Kazama et al. ..... 399/406
7,383,017 B2 * 6/2008 Ushio ..... 399/406
7,697,884 B2 * 4/2010 Tateishi ..... 399/406
2008/0061488 A1 * 3/2008 Keyes et al. ..... 270/1.01
2008/0159795 A1 * 7/2008 Mori et al. ..... 399/406

FOREIGN PATENT DOCUMENTS

JP 06258906 A * 9/1994
JP 09062145 A * 3/1997
JP 10231061 A * 9/1998
JP 2009029554 A * 2/2009
JP 2009-029554 12/2009
JP 2009288452 A * 12/2009
JP 2010002738 A * 1/2010

* cited by examiner

*Primary Examiner* — Matthew G Marini
*Assistant Examiner* — Nguyen Ha
(74) *Attorney, Agent, or Firm* — Smith, Gambrell & Russell, LLP

(57) ABSTRACT

An image-forming apparatus having an image-forming unit, a fixation unit for fixing a toner image transferred to paper, a double-sided print conveyance path for conveying the paper imprinted on one side toward the image-forming unit, a decurling unit for passing the paper discharged from the fixation unit in a double-roller nip including a hard roller and a soft roller and decurling the paper, a rotation unit for rotating the decurling unit, and a calculation unit for calculating an amount of toner deposited on each of a first side, which is the side printed first, and a second side, which is the side on the reverse of the first side and is the side printed next. The rotation unit rotates the decurling unit on the basis of calculation results from the calculation unit.

16 Claims, 13 Drawing Sheets

Fig.9A
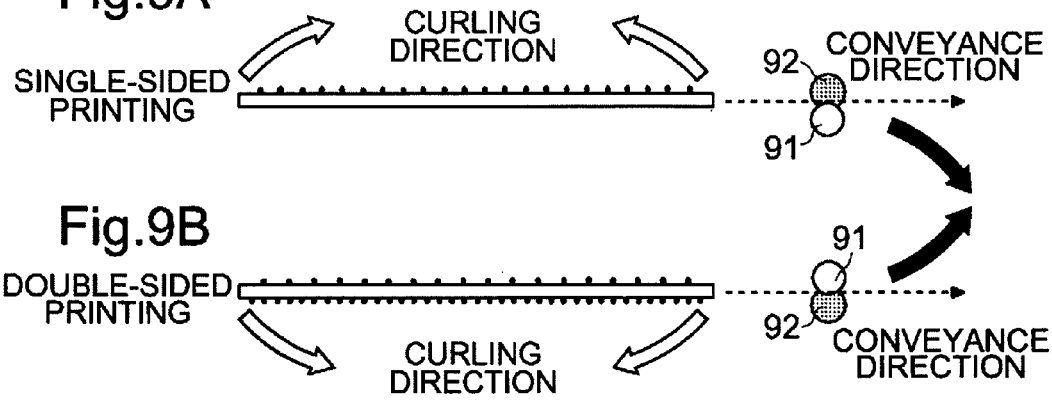
Fig.9B
Fig.10
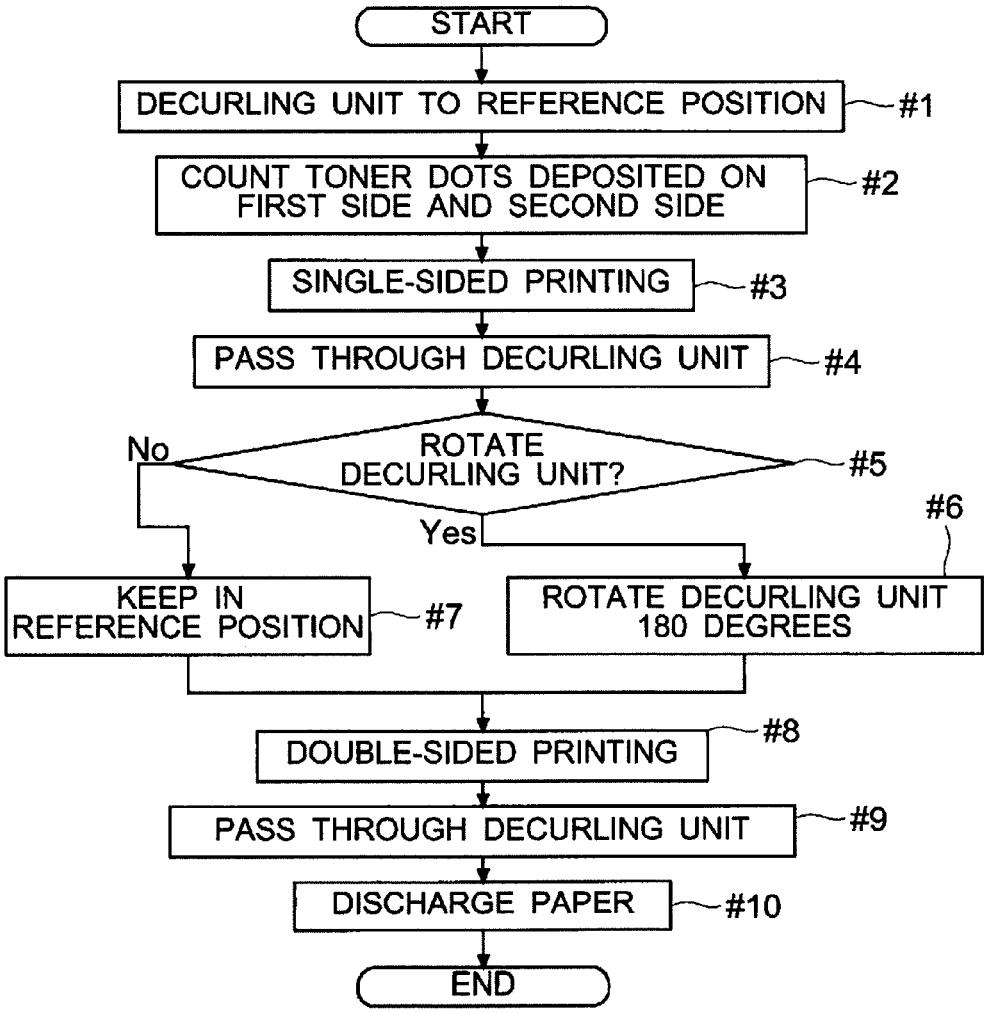

IMAGE-FORMING APPARATUS AND METHOD FOR CONTROLLING IMAGE-FORMING APPARATUS

This application is based on Japanese Patent Application No. 2010-015157 filed on Jan. 27, 2010, and Japanese Patent Application No. 2010-229090 filed on Oct. 8, 2010, the entire contents of which are hereby incorporated by reference.

BACKGROUND OF THE INVENTION

1. Field of the Invention

The present invention relates to a copier, multifunction peripheral, fax machine, printer, or other image-forming apparatus that includes a decurling device for removing curling from paper.

2. Description of Related Art

In some copiers, multifunction peripherals, fax machines, printers, and other image-forming apparatuses, a formed toner image is transferred to paper, and the toner image is heated and pressed by a roller, or the like, whereby it is affixed to the paper. When the toner image is fixed to the paper, the paper may curl due to contraction of the toner, evaporation of moisture in the paper, winding of the paper onto the roller due to tackiness of the toner, or other reasons. When paper is discharged in a curled state to the discharge tray, gaps between printed pages become larger, and the stacking capacity of the discharge tray is reduced. A disorderly stacking state due to catching of curled sections on discharged pages also may occur. A decurling device for removing curling from paper may therefore be provided.

For example, there is known a curl-removing device for removing curling from a recording medium in an image-forming apparatus, the curl-removing device having a roller pair including a soft roller made of a flexible material and a hard roller pressed against the soft roller in parallel with the soft roller; a casing having a recording medium conveyance path formed therein, and accommodating the roller pair so as to face the conveyance path, a roller drive device for driving the roller pair to rotate, and a casing rotation device for causing the casing to rotate around a shaft parallel with a roller shaft of the roller pair. This configuration provides a curl-removing device that takes little space compared with a conventional device, and is less likely to result in paper jams.

For example, a decurling device has a roller pair comprising a hard metal roller and a soft roller pressed against the hard roller, and toner-fixed paper is passed through a nip between the rollers to remove the curling. The decurling device is fixed in position, and the curl removal direction is therefore fixed. However, there are cases when one wishes to change the curl removal direction. Therefore, a plurality of conveyance paths is provided, and the direction for passing paper to the decurling device is changed, or two decurling devices with switched positions of the hard roller and the soft roller are provided. The aforementioned invention provides a major advantage in that the curl removal direction can be changed by the casing rotation device, and a plurality of conveyance paths or decurling devices is not necessary.

However, according to the conventional art, the user must select and set the curl removal direction, and there is a problem in convenience for the user. In the case of double-sided printing in particular, the user must predict the curl removal direction, and setting of the curl removal direction is troublesome. Also in the case of double-sided printing, the user may not be able to predict the direction in which the paper curls. The paper may therefore end up passing through the decurling unit in a direction whereby curling is exacerbated. Consequently, there is also a problem that decurling may not be accomplished assuredly.

SUMMARY OF THE INVENTION

In view of the problems of the conventional art above, an object of the present invention is to enable a decurling unit to be automatically rotated on the basis of calculation results concerning an amount of toner deposited on each side in double-sided printing, so that the user is freed from the trouble of setting the curl removal direction, and decurling is reliably performed.

In order to achieve the aforementioned object, an image-forming apparatus according to an aspect of the present invention comprises: an image-forming unit for forming a toner image transferred to paper, based on image data; a fixation unit for fixing the toner image transferred to the paper; a double-sided print conveyance path for connecting a lower path in the paper conveyance direction from the fixation unit and an upper path in the paper conveyance direction from the image-forming unit, and, for double-sided printing, conveying a paper imprinted on one side toward the image-forming unit; a decurling unit for passing the paper discharged from the fixation unit through a double-roller nip and uncurling the paper, the nip including a hard roller and a soft roller that is softer than the hard roller and is pressed against the hard roller; a calculation unit for using image data related to respective sides in double-sided printing to calculate an amount of toner deposited on each of a first side, which is the side printed first, and a second side, which is the side on the reverse of the first side and is the side printed next; and a rotation unit for rotating the decurling unit on the basis of calculation results from the calculation unit in order to change a curl removal direction.

According to the aspect described above, the decurling unit can be automatically rotated on the basis of calculation results concerning an amount of toner deposited on each side in double-sided printing, and curling can be removed. The user therefore does not need to set the curl removal direction for each double-sided printing of each page, and decurling is also accomplished assuredly.

Further features and advantages of the present invention will become apparent from the description of embodiments given below.

BRIEF DESCRIPTION OF THE DRAWINGS

FIG. 9A and FIG. 9B are diagrams used to illustrate curling of paper.

FIG. 10 is a flow chart for describing one example of rotational control of the decurling unit of the first embodiment during double-sided printing.

DETAILED DESCRIPTION OF PREFERRED EMBODIMENTS

A first embodiment of the present invention is described below with reference to FIGS. 1 to 12. However, the configurations, arrangements, and other elements described in each embodiment are merely for purposes of description and shall not be construed to limit the scope of the invention.

(Outline of the Image-Forming Apparatus)

Figure 1:
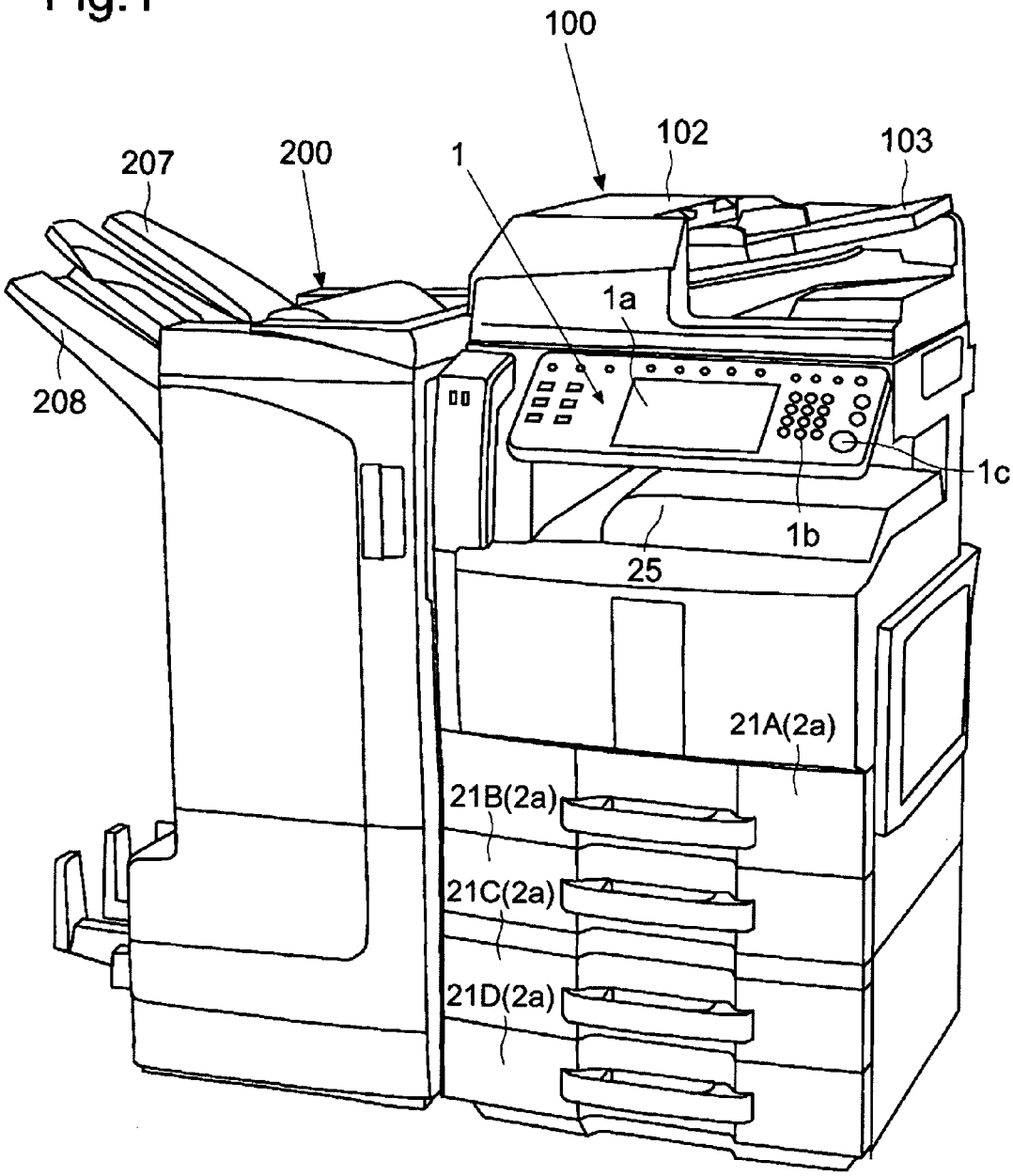
FIG. 1 is a perspective view illustrating one example of the multifunction peripheral of the first embodiment.

A multifunction peripheral 100 according to a first embodiment of the present invention is first described in general with reference to FIG. 1. FIG. 1 is a perspective view illustrating one example of the multifunction peripheral 100 according to the first embodiment of the present invention.

As illustrated in FIG. 1, the multifunction peripheral 100 of the present embodiment (corresponding to the image-forming apparatus) includes a post-processing device 200 as an optional device provided on the left side face. The post-processing device 200 is used for taking in paper imprinted by the multifunction peripheral 100, and performing stapling and other processing. An operating panel 1 is also provided facing forward on the front face of the multifunction peripheral 100.

The operating panel 1 has a liquid-crystal display unit 1*a* for displaying menus or keys for providing settings or operating instructions to the multifunction peripheral 100 or the post-processing device 200. The liquid-crystal display unit 1*a* is of a touch-panel type. The user presses keys displayed by the liquid-crystal display device 1*a* to provide settings for double-sided printing in copying by the multifunction peripheral 100, or to provide settings or operating instructions to the post-processing device 200. For example, the user can use the post-processing device 200 to input an instruction to perform stapling or a setting for the discharging direction of the paper. A numeric key unit 1*b* for inputting numbers, a start key 1*c* for instructing execution of copying, or the like, after providing a variety of settings, and other keys also are provided on the operating panel 1.

(Configuration of Multifunction Peripheral 100)

Figure 2:
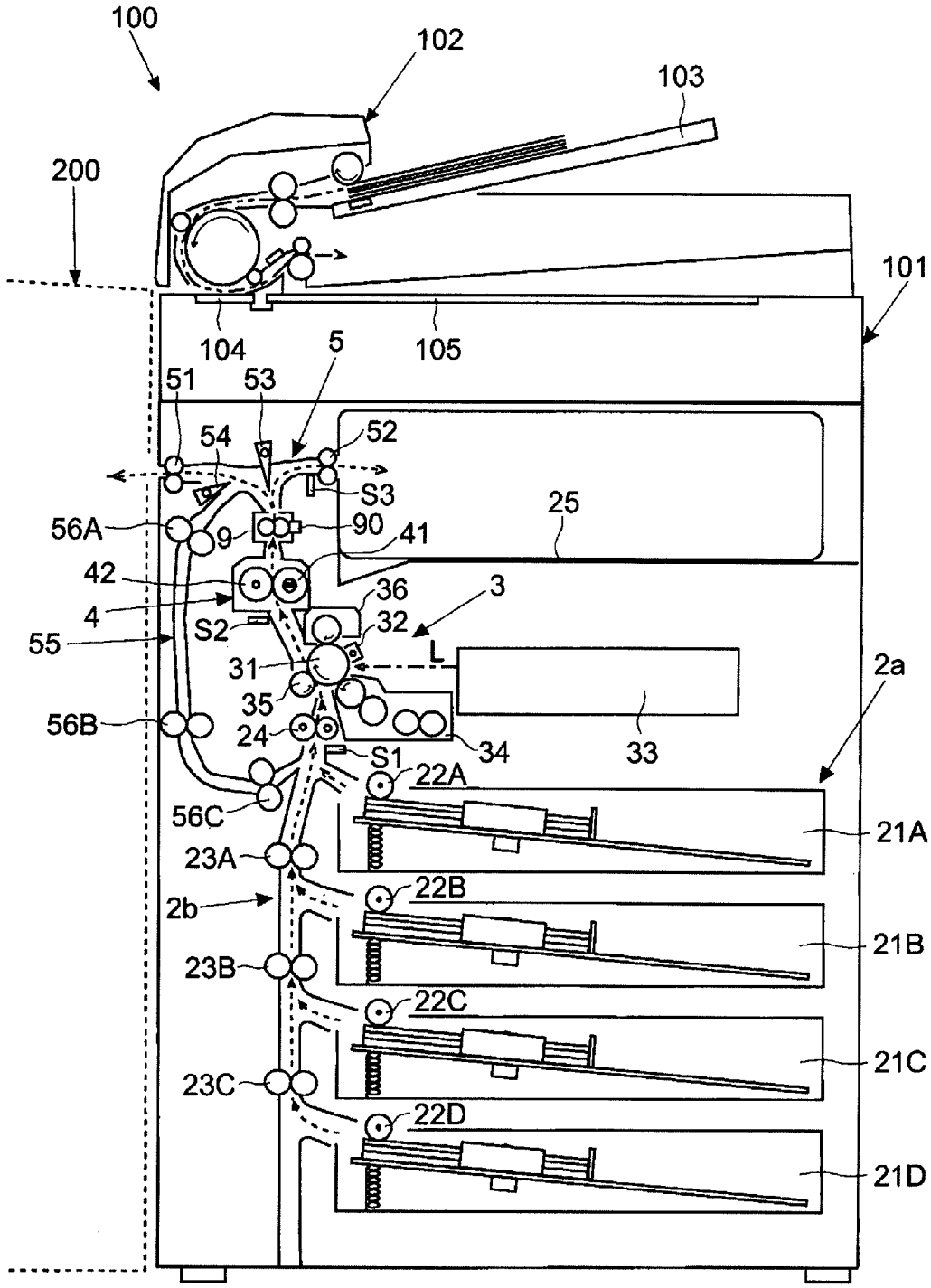
FIG. 2 is a typical front sectional view illustrating one example of the configuration of the multifunction peripheral of the first embodiment.

The configuration of the multifunction peripheral 100 according to the first embodiment of the present invention is next described with reference to FIG. 1 and FIG. 2. FIG. 2 is a typical front sectional view illustrating one example of the configuration of the multifunction peripheral 100 according to the first embodiment of the present invention.

The multifunction peripheral 100 of the present embodiment has an image-reading unit 101 and a copy-conveying device 102 at the top. The multifunction peripheral 100 has a paper-feeding unit 2*a*, a conveyance path 2*b*, an image-forming unit 3, a fixation unit 4, a decurling unit 9, and a discharge-conveying unit 5 inside a main unit.

The copy-conveying device 102 has a copy tray 103 in which copies to be read in are placed. The copy-conveying device 102 is used for automatically and continuously conveying copies one sheet at a time from the copy tray 103 to a reading position (contact glass 104 for auto-feed reading). The copy-conveying device 102 is also attached to the image-reading unit 101 so as to be capable of opening along a fulcrum located on the perspectively distant side of FIG. 1. The copy-conveying device 102 functions as a cover for pressing from above each contact glass of the image-reading unit 101.

Next, as illustrated in FIG. 1, the image-reading unit 101 includes on the top face a contact glass 104 for auto-feed reading, and a contact glass 105 for fixed reading for placing copies when reading in books or other copies one sheet at a time. A lamp, mirror, lens, image sensor, and the like (not illustrated), are also disposed inside the image-reading unit 101. The image sensor is used for reading a copy on the basis of reflected light from a copy passing through the contact glass 104 for auto-feed reading or from a copy mounted on the contact glass 105 for fixed reading. The image sensor is also used for converting the reflected light into analog electrical signals corresponding to the image density, and then quantizing the signals to obtain image data of the copy.

The paper-feeding unit 2*a* in the multifunction peripheral 100 includes a plurality of cassettes 21 (four tiers 21A, 21B, 21C, 21D in total of from the top in FIG. 2). Each cassette 21 accommodates a plurality of sheets of paper of each size (for example, letter size, legal size, A4, B4, or other A-size and B-size paper) and of each kind of paper (for example, copy paper, reproduction paper, thick paper, and OHP sheet). Each of the cassettes 21 has a rotationally driven paper-feeding roller 22 (four rollers 22A, 22B, 22C, 22D in total from the top in FIG. 2), and is used for feeding paper one sheet at a time into the conveyance path 2*b* during printing.

The conveyance path 2*b* is a path for conveying paper inside the apparatus. A guide plate for guiding paper, a conveyance roller pair 23 (three rollers 23A, 23B, and 23C in total from the top in FIG. 2) rotationally driven during conveyance of paper, a resist roller pair 24 for holding conveyed paper upstream of the image-forming unit 3, and feeding the paper out in synchronization with a transfer timing of a formed toner image, and the like, are provided in the conveyance path 2*b*.

The image-forming unit 3 has a photosensitive drum 31 supported to be capable of rotational driving in the direction of the arrow indicated in FIG. 2, and a charging device 32, an exposing device 33, a developing device 34, a transfer roller 35, and a cleaning device 36 arranged around the photosensitive drum 31. The image-forming process shall now be described. The charging device 32 is used for charging the photosensitive drum 31 rotationally driven in a predetermined direction to a predetermined potential. The exposing device 33 is used for intermittently outputting laser light L on the basis of image data read by the image-reading unit 101 or image data stored in a memory unit 12 to be described, scanning and exposing the photosensitive drum 31, and forming an electrostatic latent image according to the image data. The developing device 34 is used for supplying toner to develop the electrostatic latent image formed on the photosensitive drum 31 and to form a toner image.

The transfer roller 35 to the left of the photosensitive drum 31 is pressed against the photosensitive drum 31 to form a nip. The resist roller pair 24 advances paper into the nip at a given timing. When the paper and the toner image are advanced into the nip, a predetermined voltage is applied to the transfer roller 35, and the toner image on the photosensitive drum 31 is transferred to the paper. The cleaner is used for removing residual toner, and the like, on the photosensitive drum 31 after transfer.

The fixation unit 4 is used for fixing the toner image that was transferred to the paper. The fixation unit 4 is mainly configured with a heating roller 41 having an exothermic body inside, and a pressing roller 42 for pressing thereto. When the paper passes through the nip of the heating roller 41 and the pressing roller 42, the toner is melted and heated, and the toner image is fixed to the paper. The paper discharged from the fixation unit 4 is sent to the decurling unit 9.

The decurling unit 9 is provided, for example, above the fixation unit 4. The paper discharged from the fixation unit 4 passes through the decurling unit 9. The decurling unit 9 is a section for removing curling from paper, and includes a hard roller 91, and a soft roller 92 pressed against the hard roller 91. The details of the decurling unit 9 will be described later.

The discharge-conveying unit 5 is used for specifying the paper conveyance direction to convey imprinted paper toward the post-processing device 200, toward a discharge tray 25, or toward a double-sided conveyance path 55 (corresponding to the double-sided print conveyance path). The discharge-conveying unit 5 has a discharge roller pair 51 for sending paper out toward the post-processing device 200, and a discharge roller pair 52 for sending paper out toward the discharge tray 25 or inverting rotation and switchbacking for double-sided printing. Each discharge roller pair 51, 52 is rotationally driven. The discharge-conveying unit 5 also has, for example, two switching valves 53, 54 for switching the paper conveyance direction. Each switching valve 53, 54 rotates, and guides paper toward a discharge destination specified at the operating panel 1, or the like, or guides paper imprinted on one side to the double-sided conveyance path 55 during double-sided printing.

The double-sided conveyance path 55 is used for connecting a downstream side of the fixation unit 4 and an upstream side of the resist roller pair 24. A plurality of rotationally driven double-sided roller pairs 56 (a total of 3: 56A, 56B, and 56C) for double-sided printing is provided in the double-sided conveyance path 55, whereby the paper imprinted on one side is conveyed.

(Configuration of Post-Processing Device 200)

Figure 3:
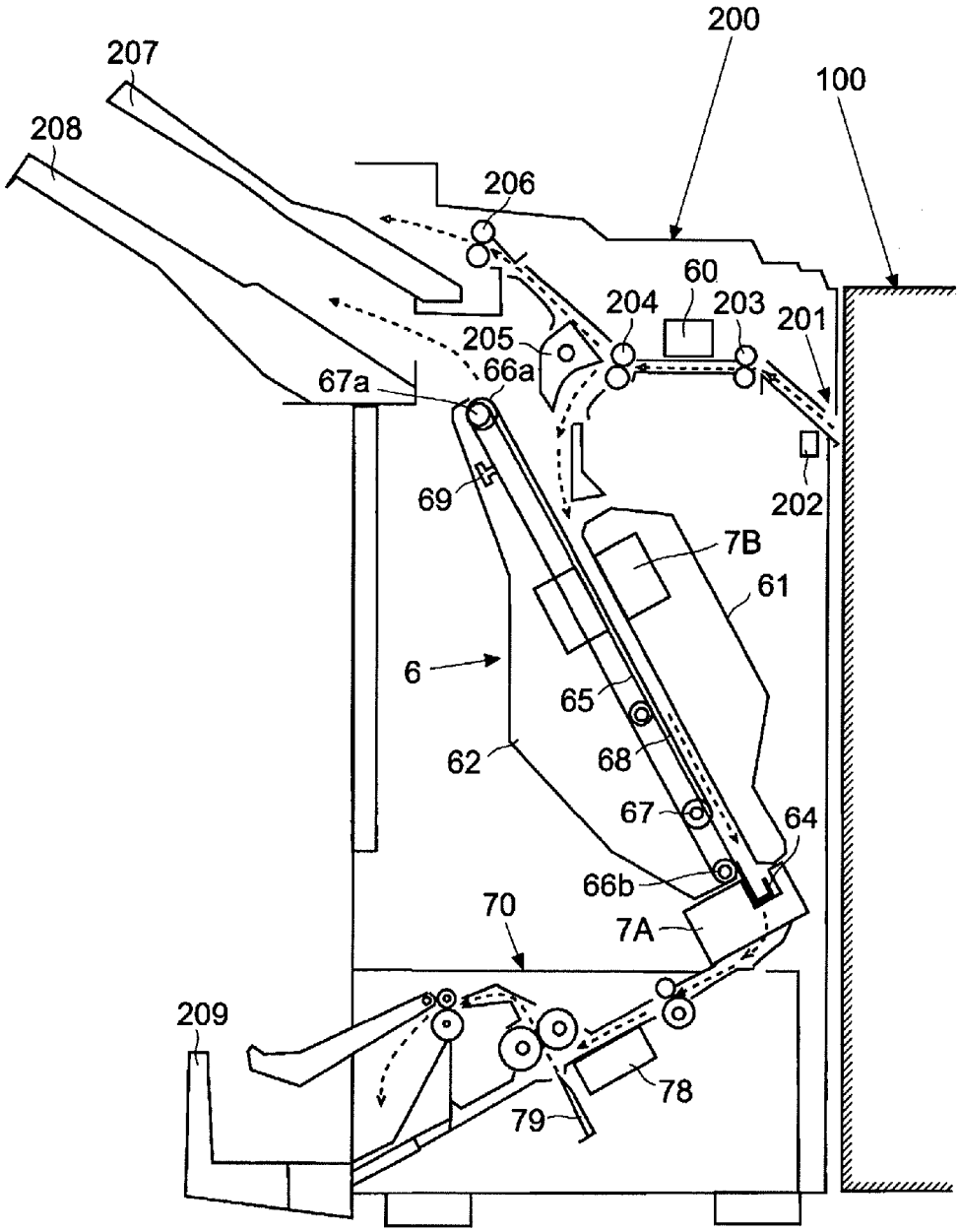
FIG. 3 is a typical front sectional view illustrating one example of the configuration of the post-processing device of the first embodiment.

An example of the configuration of the post-processing device 200 according to the first embodiment of the present invention is next described with reference to FIG. 3. FIG. 3 is a typical front sectional view illustrating one example of the configuration of the post-processing device 200 according to the first embodiment of the present invention.

As illustrated in FIG. 3, the post-processing device 200 is provided with a stacking unit 6 for temporarily storing a paper stack, a punching unit 60 for punching the paper stack in the stacking unit 6, a stapling unit 7A (for stapling a leading end side of the paper viewed from the direction of stacking) and a stapling unit 7B (for stapling a trailing end side of the paper) for stapling the paper stack in the stacking unit 6, a middle-folding unit 70, and the like. The stacking unit 6 is used for forming a plurality of sheets of paper into a stack. The middle-folding unit 70 includes a saddle-stapling unit 78, and is used for folding along the staples a paper stack saddle-stapled by the saddle-stapling unit 78.

Each process of the post-processing device 200 is described specifically. Imprinted paper discharged from the multifunction peripheral 100 to the post-processing device 200 is first conveyed into the post-processing device 200 through a conveyer entrance 201 provided on the front face of the post-processing device 200. For example, a paper sensor 202 for sensing conveying-in of paper (for example, a light sensor, a switch that is turned on and off by passage of paper, or the like) is provided is provided in the vicinity of the conveyer entrance 201. Paper sensors 202 may be provided in a plurality of locations inside the post-processing device 200 in addition to the vicinity of the conveyer entrance 201.

The punching unit 60 is provided downstream of the conveyer entrance 201. The punching unit 60 is used for punching the paper. Conveyance roller pairs 203, 204 that are rotationally driven to convey the paper, and a guide claw 205 that is rotated in conformance with a paper conveyance destination are provided downstream of the punching unit 60. In the case when stapling, or the like, is selected by input to the operating panel 1, or the like, the guide claw 205 is rotated so that the paper is sent into the stacking unit 6 beneath the guide claw 205. The paper is conveyed toward the stacking unit 6 as a result. In the case of folding, the paper is stacked in the stacking unit 6, and is then further conveyed toward the middle-folding unit 70.

On the other hand, in the case when punching or stapling is not selected (in the case when no processing is to be performed by the post-processing device 200), the guide claw 205, for example, is rotated so that the paper is sent into a discharge roller pair 206 above the guide claw 205. The paper is discharged from the discharge roller pair 206 to an auxiliary discharge tray 207 as a result.

The stacking unit 6 shall now be described. The stacking unit 6 includes a cover tray 61 and a stack tray 62. The conveyed paper passes between the cover tray 61 and the stack tray 62. The paper is stacked on the top surface of the stack tray 62. The cover tray 61 functions as a cover for pressing the paper stack from above.

The stapling unit 7A for stapling the leading end side of the paper (the lower side of the stacked paper), and the stapling unit 7B for stapling the trailing end side of the paper (the upper side of the stacked paper) are provided accompanying the stacking unit 6. Each stapling unit 7 performs diagonal stapling, in which, for example, one staple is placed diagonally at 45° in one corner of the top end of the paper stack. The stacking unit 6 conveys the stapled or otherwise processed paper stack upward and discharges the paper to a main discharge tray 208.

The middle-folding unit 70 is disposed beneath the stacking unit 6. When folding is selected by input to the operating panel 1, or the like, the paper stack formed in the stacking unit 6 is conveyed toward the middle-folding unit 70. For example, the saddle-stapling unit 78 for performing saddle-stapling of a paper stack is provided at mid-course of the conveyance path from the stacking unit 6 to the middle-folding unit 70. The saddle-stapling unit 78 performs saddle-stapling, in which, for example, two staples are placed along the short direction in the center of the long direction of the paper stack. The saddle-stapled paper stack is bent by a projecting rod 79 of the middle-folding unit 70, and is then discharged to a booklet tray 209.

(Paper Adjustment and Paper Conveyance in Stacking Unit 6)

Figure 4:
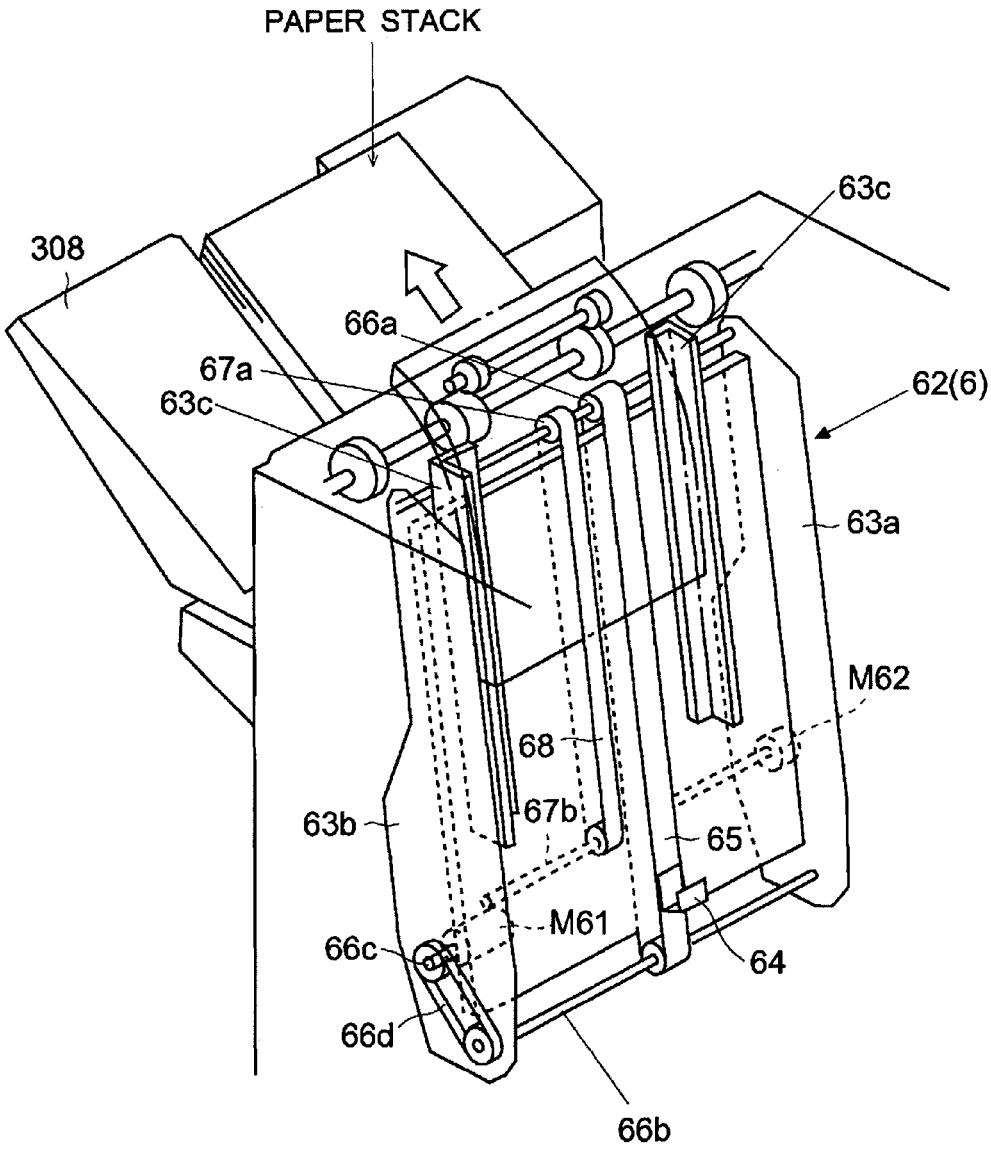
FIG. 4 is a generalized perspective view illustrating the paper conveying mechanism of the stack tray of the post-processing device of the first embodiment.

An outline of a paper adjustment and paper conveying mechanism of the stack tray 62 in the post-processing device 200 is next described with reference to FIG. 4. FIG. 4 is a generalized perspective view illustrating the paper conveying mechanism of the stack tray 62 of the post-processing device 200 according to the first embodiment of the present invention.

As illustrated in FIG. 4, a pair of side plates 63*a* and 63*b* is provided on the left and right on the stack tray 62. A pair of rocking plates 63*c* for holding paper therebetween is provided between the side plates 63. The pair of rocking plates 63*c* rocks horizontally to adjust the paper. The paper sent to the stacking unit 6 passes between the cover tray 61 and the stack tray 62, and between the side plates 63*a* and 63*b*, and the leading end is stopped by a stopper 64 that has a substantially square-bracket shape in cross-section.

The stopper 64 is attached to an endless first belt 65 provided substantially in the center of the width direction of the stack tray 62. The stack tray 62 is provided with a pulley 66*a* at the upper end and a rotating shaft 66*b* (drive rotating shaft) at the lower end, and the first belt 65 is hung on these. A pulley belt 66*d* is hung around the rotating shaft 66*b* on the lower end and a rotating shaft 66*c* of a motor M61. The motor M61 is driven forward and backward, whereby the first belt 65 is driven forward and backward via the pulley belt 66*d* and the rotating shaft 66*b*, and the paper stack can be moved upward and downward.

A rotating shaft 67*b* is also provided somewhat downward from the center on the stack tray 62. An endless second belt 68 arranged along the center line of the stack tray 62 is hung around a pulley 67*a* and a rotating shaft 67*b*. The pulley 66*a* of the first belt 65 and the pulley 67*a* of the second belt 68 are not operationally linked. An adjusting member 69 (see FIG. 3) is attached projecting outward on the second belt 68, which is driven to rotate freely forward and backward on the stack tray 62.

As illustrated in FIG. 3, the adjusting member 69 is formed substantially in a T shape. The rotating shaft 67*b* (drive rotating shaft), around which the second belt 68 is hung, is driven to rotate freely forward and backward by a motor M62, whereby the adjusting member 69 is moved. The adjusting member 69 is used for lightly pressing the upper end of the paper to adjust to straighten out the paper. This operation is performed each time a sheet of paper is stacked, and the adjusting member 69 is returned to a second side of the stack tray 62 each time a sheet is pressed.

The leading end or trailing end of the paper can be stapled regardless of paper size, for example, by moving the stopper 64 upward or downward. When stapling is completed, the first belt 65 is rotated in a direction to convey the paper stack upward, and the leading end of the paper stack is pushed upward by the stopper 64. The paper stack is thereby discharged to the main discharge tray 208. In the case when bending is selected, the first belt 65 and the second belt 68 are again rotated in synchronization in a direction to convey the paper stack upward. The paper stack is conveyed downward while the lower end is supported by the stopper 64 and the upper end is supported by the adjusting member 69, and the paper stack is sent out to the middle-folding unit 70 (see FIG. 1).

(Decurling Unit 9)

Figure 5:
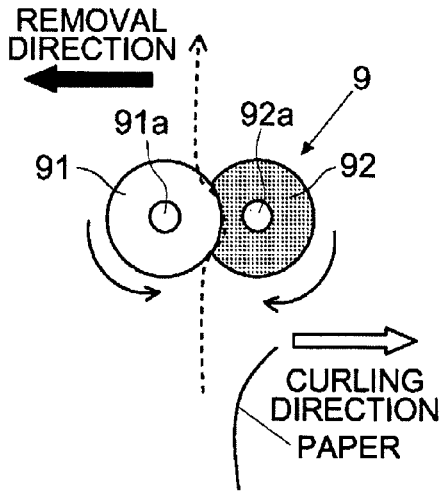
FIG. 5 is a typical sectional view of the decurling unit of the first embodiment.

An outline of curl removal by the decurling unit 9 according to the first embodiment of the present invention is next described with reference to FIG. 5. FIG. 5 is a typical sectional view of the decurling unit 9 according to the first embodiment of the present invention.

As illustrated in FIG. 5, the decurling unit 9 includes a hard roller 91 made of metal, or the like (for example, aluminum or steel), and a soft roller 92 made of silicon sponge, synthetic resin, or other material that is softer than the hard roller 91 and yields inward. The hard roller 91 and the soft roller 92 are pressed to such an extent that the hard roller 91 bites into the soft roller 92. A shaft 91*a* of the hard roller 91 and a shaft 92*a* of the soft roller 92 are parallel to each other.

It shall be assumed that a paper has been curled in the direction indicated by the solid-white arrow (toward the side of the soft roller 92). The curled paper also passes through the nip of the hard roller 91 and the soft roller 92 in the direction indicated by the dashed line in FIG. 5. The curl is thus removed in the direction indicated by the solid-black arrow in FIG. 5. Because the hard roller 91 bites into the soft roller 92, the paper is conveyed so that a curl is applied in the direction of the hard roller 91 when the paper passes through the nip, whereby the curl toward the direction of the soft roller 92 is cancelled out, and the curl is removed from the paper.

(Inversion of Curl Removal Direction in Decurling Unit 9)

Figure 6A:
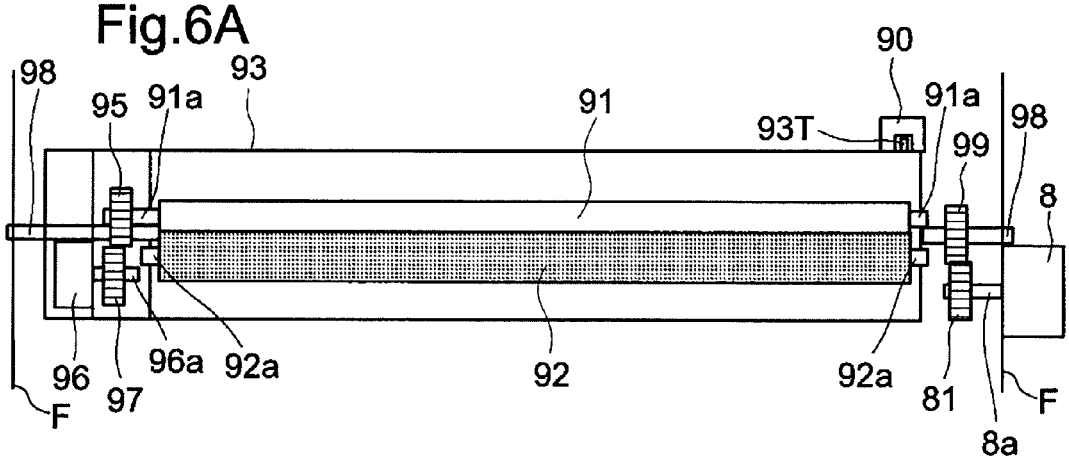
FIG. 6A is a generalized structural diagram illustrating one example of the mechanism for rotatably driving the decurling unit according to the first embodiment.
Figure 6B:
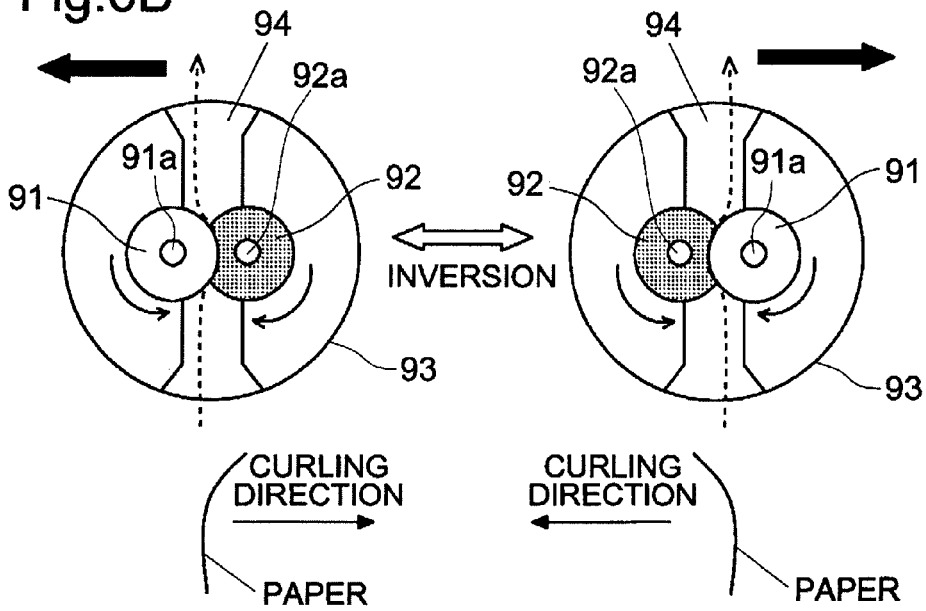
FIG. 6B is a typical sectional view for illustrating the change of the curl removal direction when the decurling unit is caused to rotate.

An example of inversion of the curl removal direction in the decurling unit 9 according to the first embodiment of the present invention is next described with reference to FIG. 6. FIG. 6A is a generalized structural diagram illustrating one example of the rotating mechanism of the decurling unit 9 according to the first embodiment of the present invention. FIG. 6B is a typical sectional view for illustrating the change of the curl removal direction when the decurling unit 9 is rotated.

As illustrated in FIG. 6, the hard roller 91 and the soft roller 92 are housed inside a case 93. A shaft 91*a* and a shaft 92*a* of the rollers are respectively supported (*2) to rotate freely on bearings provided on the case 93. As illustrated in FIG. 6B, a passage 94 through which paper passes is formed on the case 93. This passage 94 is large enough for curled paper to enter, and openings on both sides serving as an entrance and an exit for the paper widen in a funnel form.

A gear 95 is attached on one end of the shaft 91*a* of the hard roller 91. A roller-rotating motor 96 is provided inside the case 93. A gear 97 is attached to an output shaft 96*a* of the roller-rotating motor 96. Teeth of the gear 95 and of the gear 97 mutually engage. The hard roller 91 therefore rotates when the roller-rotating motor 96 is driven. The soft roller 92 is pressed to the hard roller 91, and rotates following rotation of the hard roller 91.

Two rotating shafts 98 project from the case 93, running through the centers of the circular faces of the case 93 in the axial direction of each roller. Each rotating shaft 98 is supported to rotate freely on a frame F of the multifunction peripheral 100. A gear 99 is attached to the end of one of the rotating shafts 98. A case-rotating motor 8 (corresponding to the rotation unit) for rotating the case 93 attached to the frame F is provided in a position opposite the gear 99. A gear 81 is provided on an output shaft 8*a* of the case-rotating motor 8, and teeth of the gear 99 and of the gear 81 mutually engage. The case 93 therefore rotates when the case-rotating motor 8 is driven.

The case-rotating motor 8 is rotated and the decurling unit 9 is rotated 180 degrees, whereby the curl removing direction can be inverted as indicated by the solid-black arrow in FIG. 6B. By this, for example, no matter which direction the paper discharged from the fixation unit 4 is curled, the decurling unit 9 can be rotated and the curling can be precisely removed.

(Hardware Configuration of Multifunction Peripheral 100 and Other Components)

Figure 7:
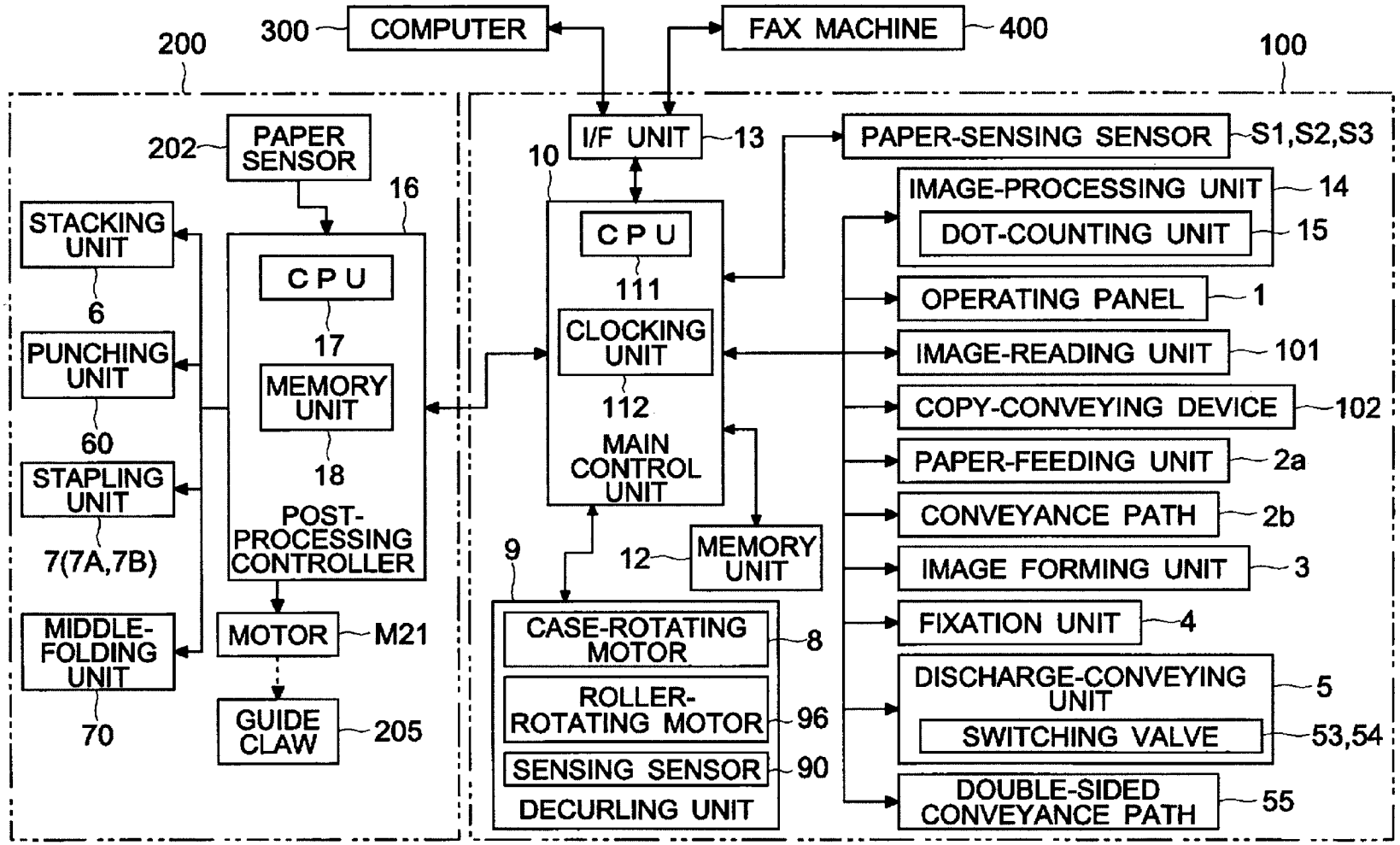
FIG. 7 is a block diagram illustrating one example of the hardware configuration of the multifunction peripheral of the first embodiment.

An example of the hardware configuration of the multifunction peripheral 100 and other components according to the first embodiment of the present invention is next described using FIG. 7. FIG. 7 is a block diagram illustrating one example of the hardware configuration of the multifunction peripheral 100 and other components, according to the first embodiment of the present invention.

The description is first given from the side of the main unit of the multifunction peripheral 100. A main control unit 10 is provided inside the main unit of the multifunction peripheral 100. The main control unit 10 is connected, for example, to the operating panel 1, the copy-conveying device 102, the image-reading unit 101, the paper-feeding unit 2*a*, the conveyance path 2*b*, the image-forming unit 3, the fixation unit 4, the discharge-conveying unit 5, and the double-sided conveyance path 55, and is used for controlling these.

The main control unit 10 is configured, for example, using a CPU 111 and a clocking unit 112. The CPU 111 is used for performing calculations on the basis of a control program stored in and unpacked from a memory unit 12, and for controlling each unit of the multifunction peripheral 100. Main control unit 10 also may be provided by dividing by function, such as a main controller for performing overall control and image processing, and an engine controller for controlling image formation, on-off switching of motors for rotating a variety of rotating bodies, and printing. An aspect in which these controllers are combined is presented and described.

The memory unit 12 is connected with the main control unit 10. The memory unit 12 is incorporated with a ROM, a RAM, an HDD, and other nonvolatile and volatile memory devices. The memory unit 12 is capable of storing control programs, control data, settings data, image data, and a variety of other data of the multifunction peripheral 100. Particularly as concerns the present invention, the memory unit 12 stores data and programs related to control of rotation of the decurling unit 9.

The main control unit 10 is connected with an interface unit (hereinafter referred to as "I/F unit 13") having a variety of connectors, sockets, and a fax modem, and the like. The I/F unit 13 is connected by a network or public circuit with a plurality of external computers 300 (for example, PCs) or other-party fax machines 400 (in FIG. 7, both are respectively indicated for convenience). For example, image data obtained from the image-reading unit 101 can be transmitted to an external computer 300 or other-party fax machine 400 (scanner function, fax function). Printing, fax transmission, or the like, also can be performed on the basis of image data transmitted from an external computer 300 or other-party fax machine 400 and input to the multifunction peripheral 100 (printer function, fax function).

The main control unit 10 is also used for controlling the multifunction peripheral 100 to recognize inputs made to the operating panel 1 so that copying and other functions are performed in conformance with user settings. When a setting to perform stapling using the post-processing device 200 or a setting to discharge to the auxiliary discharge tray 207 is made at the operating panel 1, for example, the main control unit 10 controls the discharge-conveying unit 5, and the switching valves 53, 54 are rotated so that imprinted paper is conveyed toward the post-processing device 200. For example, when a setting to discharge to the discharge tray 25 inside the body of the multifunction peripheral 100 is made at the operating panel 1, the main control unit 10 controls the discharge-conveying unit 5, and the switching valves 53, 54 are rotated so that the imprinted paper is conveyed to the discharge tray 25 inside the body.

An image-processing unit 14 for applying image processing to image data obtained by reading a copy in the image-reading unit 101 or image data input to the multifunction peripheral 100 via the I/F unit 13 is provided inside the multifunction peripheral 100. For example, the image data processed by the image-processing unit 14 is transmitted to the exposing device 33, and scanning and exposure of the photosensitive drum 31 is used. A dot-counting unit 15 for performing processing to count toner dots deposited in printing on the basis of image data can be provided in the image-processing unit 14.

The image-processing unit 14 may be provided inside the main control unit 10. Dot counting based on image data may be performed by the CPU 111 of the main control unit 10. Accordingly, the image-processing unit 14 (corresponding to the calculation unit) or the main control unit 10 (corresponding to the calculation unit) can be used as the calculation unit for counting deposited toner dots. The image-processing unit 14 can be used additionally for rotation, reduction and enlargement, density change, intensification, and a variety of other kinds of image processing, but giving a detailed description of a variety of image processing deviates from the substance of the present invention. Therefore, the description relates to the capability of performing well-known image processing, and other image processing is omitted.

A plurality of paper-sensing sensors S for sensing the state of conveyance of paper along the paper-conveyance path is provided inside the multifunction peripheral 100 (see FIG. 2). The paper-sensing sensor S is used for sensing the arrival and passage of paper. For example, the paper-sensing sensor S is a light sensor or a switch that is turned on and off by passage of paper. The output from the paper-sensing sensor is input to the main control unit 10. The main control unit 10 is thereby capable of sensing the state of conveyance of the paper. For example, paper-sensing sensors S can be provided in front of the resist roller pair 24 (paper-sensing sensor S1), at the entrance of the fixation unit 4 (paper-sensing sensor S2), and in the vicinity of the discharge roller pair 52 (paper-sensing sensor S3).

The main control unit 10 is also provided inside the post-processing device 200, and is connected to be capable of communicating with a post-processing controller 16 for controlling operation of the post-processing device 200. For example, the post-processing controller 16 is used for controlling the operation of the punching unit 60, the stapling unit 7, and the like, on the basis of instructions from the main control unit 10. For example, post-processing controller 16 is configured using a CPU 17, a memory unit 18, and the like. The CPU 17 is used for performing calculations, and the like, on the basis of control programs stored in and unpacked from the memory unit 18, and for controlling each unit of the post-processing device 200. The memory unit 18 is configured with a combination of ROM, RAM, and other nonvolatile and volatile memory devices. The memory unit 18 stores control programs, control data, settings data, and a variety of other kinds of data of the post-processing device 200.

For example, the post-processing controller 16 is connected with the paper sensor 202, and is used for sensing the conveyance of the imprinted paper to the post-processing device 200. For example, the post-processing controller 16 is used for controlling the rotation of a motor M21 for rotating the guide claw 205. The motor M21 is rotated forward and backward in conformance with instructions from the post-processing controller 16 (for example, to discharge to the auxiliary discharge tray 207, to convey to the stacking unit 6 for punching, or the like), and the direction of conveyance of the paper is controlled.

The post-processing controller 16 is furthermore connected with the stacking unit 6, the punching unit 60, the stapling unit 7, the middle-folding unit 70, and the like; and is used for controlling each of these units. For example, the post-processing controller 16 is used for controlling on-off switching and rotational direction of the motor M61 and the motor M62 for moving the stopper 64 provided to the stacking unit 6 and the adjusting member 69.

(Paper Discharging and Conveyance)

An example of paper discharging and conveyance in the multifunction peripheral 100 according to the first embodiment of the present invention is next described with reference to FIG. 8. FIG. 8A to FIG. 8C are enlarged typical sectional views for describing one example of paper discharging and conveyance in the multifunction peripheral 100 according to the first embodiment of the present invention.

Figure 8A:
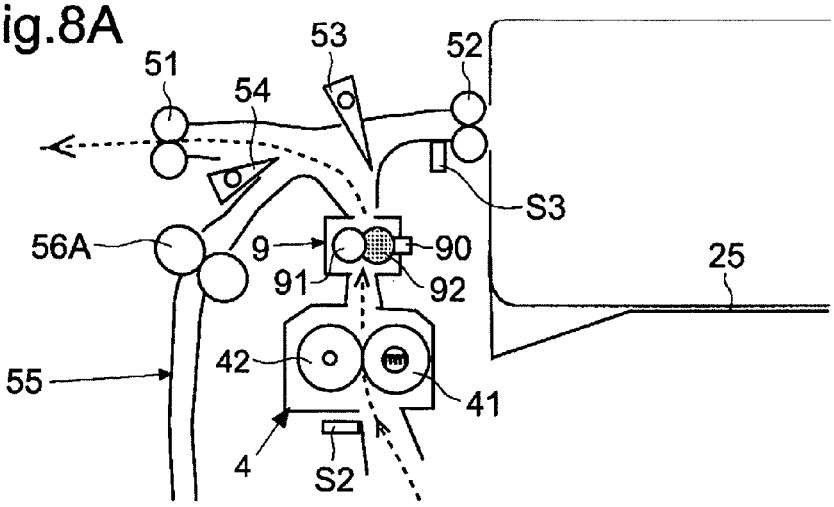
FIG. 8A to FIG. 8C are enlarged typical sectional views for illustrating one example of paper discharging and conveyance in the multifunction peripheral of the first embodiment.

FIG. 8A first illustrates the state of the discharge-conveying unit 5 when paper is discharged to the post-processing device 200. For example, when the user enters a setting to the operating panel 1 for stapling or a setting of the discharge destination to the post-processing device 200, the paper is conveyed to the post-processing device 200. The switching valves 53, 54 inside the discharge-conveying unit 5 are then caused to rotate, and the conveyance path to the discharge tray 25 is closed. The paper is thereby conveyed toward the post-processing device 200 as indicated by the dashed line in FIG. 8A.

Figure 8B:
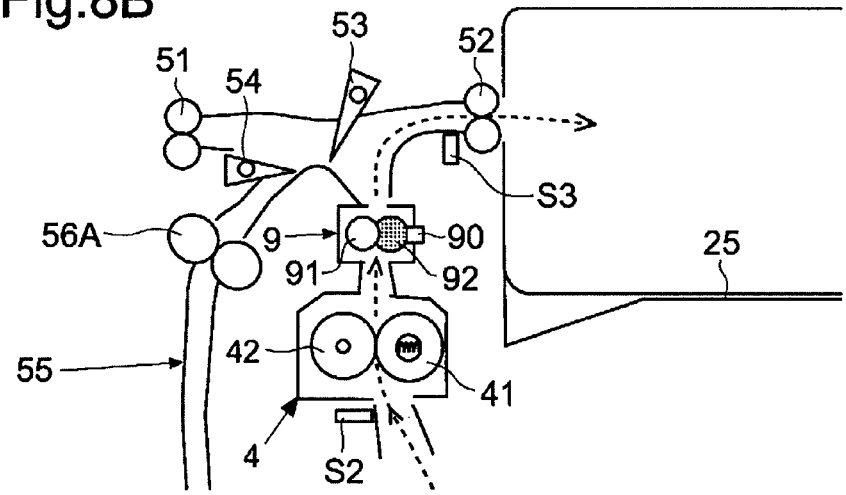

FIG. 8B illustrates the state of the discharge-conveying unit 5 when paper is discharged to the discharge tray 25 inside the body of the multifunction peripheral 100. For example, when the user makes a setting to the operating panel 1 for the discharge destination to be the discharge tray 25 inside the body, the paper is conveyed to the discharge tray 25. The switching valve 53 inside the discharge-conveying unit 5 blocks the conveyance path to the post-processing device 200 at this time. The paper is thereby conveyed toward the discharge tray 25 as indicated by the dashed line in FIG. 8B.

Figure 8C:
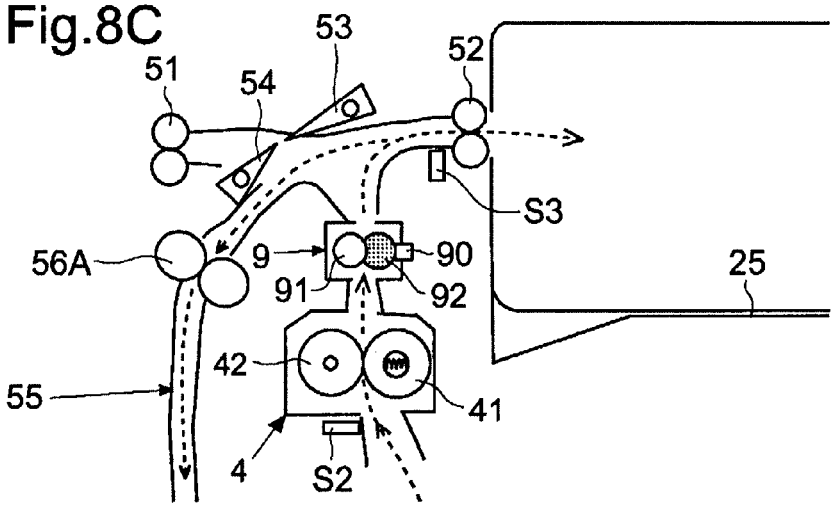

FIG. 8C next illustrates an example of switchbacking during double-sided printing. In the discharge-conveying unit 5 as illustrated in FIG. 8C, paper imprinted on one side is once conveyed toward the discharge tray 25 inside the body. The rotation of the discharge roller pair 52 is inverted (reverse-rotated) before the paper imprinted on one side completely passes through the nip of the discharge roller pair 52.

The paper is led to the double-sided conveyance path 55 by reverse-rotation of the discharge roller pair 52. At this time, the switching valves 53, 54 are rotated, the conveyance path to the post-processing device 200 is closed, and the paper imprinted on one side is led to the double-sided conveyance path 55. The reverse side of the paper is inverted as a result of the switchbacking. The paper imprinted on one side is then merged into the conveyance path 2*b* of the resist roller pair 24 from the double-sided conveyance path 55. The side yet to be imprinted is then brought into contact with the photosensitive drum 31, and a toner image is transferred to the side yet to be imprinted. During discharging of the page imprinted on both sides, the state illustrated in FIG. 8A or FIG. 8B is assumed, and the paper imprinted on both sides is discharged to the post-processing device 200 or the discharge tray 25 inside the body.

(Control of Rotation of Decurling Unit 9 During Double-Sided Printing)

An example of rotational control of the decurling unit 9 according to the first embodiment of the present invention is next described using FIG. 9 and FIG. 10. FIG. 9A and FIG. 9B are diagrams for describing curling of paper. FIG. 10 is a flow chart for describing one example of rotational control of the decurling unit 9 according to the first embodiment of the present invention during double-sided printing.

In the present description, an example of rotational control of the decurling unit 9 when stapling is not performed is given. Image data obtained by reading in the image-reading unit 101, image data transmitted from an external computer 300, image data stored in the memory unit 12, and the like, are applicable as image data used for printing.

As described above, the decurling unit 9 of the multifunction peripheral 100 of the present embodiment is capable of rotation. Curling can thereby be removed regardless of the direction in which the paper is curled, without providing a plurality of decurling units 9 or forming a complex conveyance path.

As illustrated in FIG. 9A, paper usually curls toward the direction of the side on which the toner is deposited (illustrated by black dots in each view of FIG. 9) in the case of single-sided printing. Curling of paper is caused by contraction of the toner during fixing. Evaporation of moisture is caused by heating of the paper. The temperature of the pressing roller 42 may become lower than that of the heating roller 41 in the case when continuously printing thick paper. Because toner is deposited, the heat of the heating roller 41 is not completely transmitted to the reverse side from the printed side, and the amount of evaporation of moisture may become greater on the printed side than on the reverse side (the pressing roller 42 side) of the printed side. Curling may also be caused by a difference of contraction of the paper based on a difference in the amount of evaporated moisture.

Curling of paper can be removed during single-sided printing by bringing the soft roller 92 of the decurling unit 9 into contact with the side on which the toner is deposited (printed side). Because the side on which the toner is deposited is constant in the case of single-sided printing, there is no need to rotate the decurling unit 9.

In each of the views shown in FIG. 9, an example of the direction of curling of paper is illustrated with a solid-white arrow, and an example of the curl removal direction is illustrated by the solid-black arrow. In each of the views shown in FIG. 9, the paper is illustrated as being conveyed toward the right.

Meanwhile, as illustrated in FIG. 9B, because both sides of the paper are heated during double-sided printing, curling occurs more often toward the side having a larger amount of toner deposited. For example, FIG. 9B illustrates that the amount of toner deposited is higher on the lower side, and the paper is curled toward the lower side. Curling of the paper can be removed during double-sided printing by bringing the soft roller 92 of the decurling unit 9 into contact with the side having a larger amount of toner (printed side). However, the direction to remove curling may differ from the case of single-sided printing. The main control unit 10 operates the case-rotating motor 8, and the decurling unit 9 is rotated. When the decurling unit 9 is fixed, the paper imprinted on both sides may become more intensely curled in the case when passing through the decurling unit 9, but because the curl removal direction of the decurling unit 9 can be inverted, the curling can be removed properly in the multifunction peripheral 100 of the present embodiment.

An example of rotational control of the decurling unit 9 during double-sided printing in the multifunction peripheral 100 of the embodiment of the present invention is described with reference to FIG. 10. The start in FIG. 10 is in the case when an instruction to perform double-sided printing is given in the multifunction peripheral 100 (in the case when functioning as a copier or printer).

The main control unit 10 first sets the decurling unit 9 to a reference position (step #1). The reference position is the position when the side printed first (the top side, hereinafter referred to as the "first side"; the side printed next during double-sided printing, that is, the reverse side to the first side, is referred to as the "second side") during double-sided printing contacts the soft roller 92 when the paper passes through the decurling unit 9. Specifically, the reference position of the decurling unit 9 is the position in a state of contact between the printed side and the soft roller 92 during single-sided printing. For example, the main control unit 10 does not rotate the decurling unit 9 when already in the reference position, and operates the case-rotating motor 8 to return to the reference position when not in the reference position. The reference position should be fixed during single-sided printing. The decurling unit 9 is thereby rotated so that the first side and the soft roller 92 are brought into contact in the case of a high dot count across the entire surface of the first side (obverse side) of the paper, or in the case when the first side includes a region having the highest dot count, or in the case when the first side includes a calculation-subject region F1 having a higher dot count (to be described later in further detail). Accordingly, the decurling unit 9 is rotated only in the case when necessary, and the life of the case-rotating motor 8 can be extended.

A sensing sensor 90 for sensing the rotational position (rotational angle) of the decurling unit 9 in order to ascertain the reference position is provided (see FIG. 2 and FIG. 6). For example, a light sensor can be used for the sensing sensor 90. As an example of a method for sensing the rotational angle (rotational position), for example, a projection 93T is provided on the case 93, and when the decurling unit 9 is rotated, the projection 93T passes between a light-receiving unit and a light-emitting unit of the sensing sensor 90. The output from the light-receiving unit of the sensing sensor 90 changes when the projection 93T passes between the light-receiving unit and the light-emitting unit.

Accordingly, the output from the sensing sensor 90 is input to the main control unit 10, and the rotational position of the decurling unit 9 can be obtained by the main control unit 10 from the cycle of change of output from the light-receiving unit or the set position of the projection 93T. For example, providing a design so that the projection 93T is positioned between the light-emitting unit and the light-receiving unit when in the reference position enables the main control unit 10 to recognize that the case 93 is in the rotational position of the reference position from the change of output from the light-receiving unit. The main control unit 10 stops the case-rotating motor 8 when the output from the light-receiving unit changes. The decurling unit 9 thereby comes into the reference position. The sensing sensor 90 also may be other than a transmission-type light sensor as long as the rotational angle of the decurling unit 9 can be sensed.

The image-processing unit 14 or the main control unit 10 counts the dots of toner deposited on the first side and on the second side on the basis of image data of the first side and the second side for performing double-sided printing (step #2). Printing of one side is performed (step #3). The paper passes through the decurling unit 9 (step #4). The main control unit 10 determines that the paper passed through the decurling unit 9, for example, from a passage of time sufficient for the trailing end section of the paper to pass through the decurling unit 9 after passage of the paper is sensed by the paper-sensing sensor S2 provided at the entrance of the fixation unit 4 (sensing of the arrival of paper imprinted on one side by the paper-sensing sensor S1 is also possible).

The main control unit 10 next confirms whether the decurling unit 9 should be rotated 180 degrees (step #4). Specifically, when the dot count of toner deposited is higher on the first side, curling of the paper toward the first side can be predicted, and the main control unit 10 therefore rotates the decurling unit 9 180 degrees from the reference position (YES in step #5 to step #6). On the other hand, when the dot count of deposited toner is higher on the second side, curling of the paper toward the second side can be predicted (considered the same as during single-sided printing), and the main control unit 10 keeps the decurling unit 9 in the reference position (NO in step #5 to step #7).

Specifically, the multifunction peripheral 100 (image-forming apparatus) according to the present invention comprises: an image-forming unit 3 for forming a toner image transferred to paper, based on image data; a fixation unit 4 for fixing the toner image transferred to the paper; a double-sided conveyance path 55 (double-sided print conveyance path) for connecting a lower path in the paper conveyance direction from the fixation unit 4 and an upper path in the paper conveyance direction from the image-forming unit 3, and conveying the paper imprinted on one side toward the image-forming unit 3 for double-sided printing; a decurling unit 9 for passing the paper discharged from the fixation unit 4 in a double-roller nip and uncurling the paper, the nip including a hard roller 91 and a soft roller 92 pressed against the hard roller 91 and being softer than the hard roller 91; a case-rotating motor 8 (rotation unit) for rotating the decurling unit 9 in order to change a curl removal direction; and a calculation unit (main control unit 10 or image-processing unit 14) for using image data related to respective sides in double-sided printing to calculate an amount of toner deposited on each of a first side (obverse side), which is the side printed first, and a second side (reverse side), which is the side on the reverse of the first side and is the side printed next. The case-rotating motor 8 rotates the decurling unit 9 on the basis of calculation results from the calculation unit.

The curl removal direction is thereby determined automatically. Accordingly, the user does not need to perform troublesome setting of the curl removal direction. During double-sided printing, when the curl removal direction is determined from the amount of toner deposited on each side, the case-rotating motor 8 rotates the decurling unit 9 on the basis of the calculation results from the calculation unit. The direction in which the curl is to be removed by the decurling unit 9 is thereby determined from the amount of toner deposited on each side. Accordingly, the curling of the paper can be removed exactly. Because the soft roller 92 is pressed against the hard roller 91 and assumes a state of having yielded inward, the curling can be removed from the paper toward the direction of the soft roller 92. On the other hand, during double-sided printing, curling that warps toward the side having a larger amount of deposited toner is brought about because of the heightened effect of contraction of the toner, or because the paper more readily wraps around the rotating body of the fixation unit 4 due to tackiness of the toner, or the like. The case-rotating motor 8 (rotation unit) therefore creates a state of contact between the side having a larger number of deposited toner dots and the soft roller 92. The curling of the paper can thereby be removed automatically and exactly.

Paper often curls toward the side having a larger total amount of toner due to the effect of contraction of the toner, and the like. Therefore, the calculation unit (main control unit 10 or image-processing unit 14) performs a calculation to count, based on image data, toner dots deposited on each side including the first side and the second side, and the case-rotating motor 8 (the rotation unit) brings the decurling unit 9 into a state of contact between the soft roller 92 and the side having a larger number of deposited toner dots on the basis of calculation results of a dot count. More specifically, the calculation unit performs a calculation to count toner dots deposited on the entire first side and the entire second side. The soft roller 92 can thereby be brought into contact with the side in the direction of curling, and the curling of the paper can be removed automatically and exactly.

After step #6 and step #7, double-sided printing is performed on the paper conveyed by switch-backing on the double-sided conveyance path 55 (step #8), the paper imprinted on both sides passes through the decurling unit 9 (step #9), and the paper is discharged to the post-processing device 200 or the discharge tray 25 inside the body (step #10 to end).

(Control of Rotation of Decurling Unit 9 when Stapling)

Rotational control of the decurling unit 9 during stapling in the multifunction peripheral 100 according to the first embodiment of the present invention is next described with reference to FIG. 11 and FIG. 12. FIG. 11A and FIG. 11B are diagrams illustrating one example of the dot count during stapling according to the first embodiment of the present invention. FIG. 12 is a flow chart for illustrating one example of rotational control of the decurling unit 9 during stapling in the multifunction peripheral 100 according to the first embodiment of the present invention.

In the multifunction peripheral 100 of the present embodiment, stapling can be performed in the post-processing device 200. Two stapling units 7, an upper one and a lower one, are provided in the post-processing device 200 of the present embodiment (see FIG. 3). The lower stapling unit 7A is a stapling unit 7 for binding a leading end of paper viewed from the direction of stacking (paper conveyance direction), and the upper stapling unit 7B is a stapling unit 7 for binding a trailing end of paper viewed from the direction of stacking (paper conveyance direction).

In order to perform precise stapling, there should be no curling in the section to be stapled (the section where the staple pins are secured). When there is curling, part of the paper stack might be shifted when stapling is performed, or the end of the paper may be folded by the stapling. Therefore, in the multifunction peripheral 100 of the present embodiment, in the case when stapling paper is imprinted on both sides, the decurling unit 9 is used in order to remove curling from the section to be stapled.

Figure 11A:
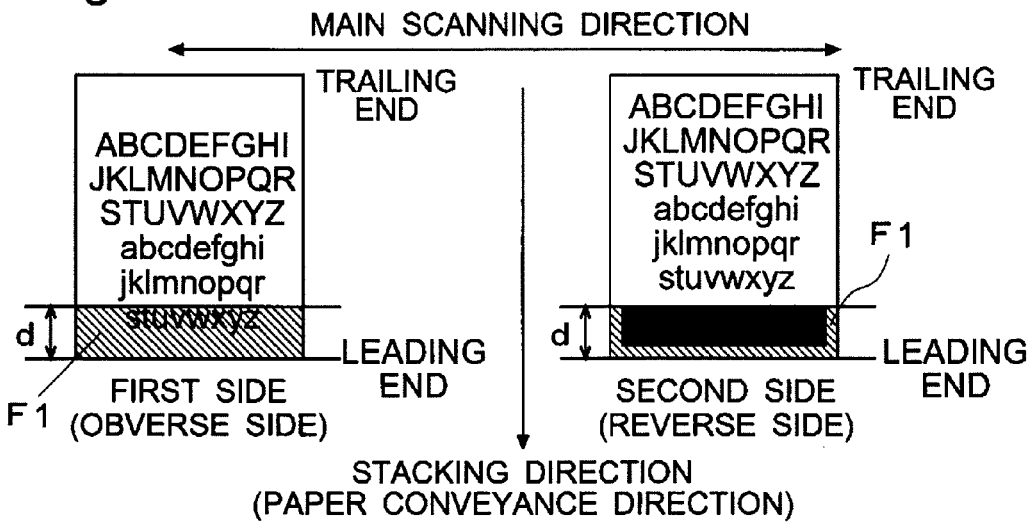
FIG. 11A and FIG. 11B are diagrams illustrating one example of the dot count during stapling of the first embodiment.

Each of the views shown in FIG. 11 illustrates paper imprinted on both sides, stacked in the stacking unit 6. FIG. 11A first illustrates an example of regions where dots are counted in image data when stapling on the leading end side of the paper (the lower side of the stacked paper) in the direction of stacking in the stacking unit 6. At this time, the stapling unit 7A is used for stapling. The main control unit 10 or the image-processing unit 14 counts the dots in the image data on each side, but attention is given to a region being the section where stapling is to be performed.

Specifically, a region of a predetermined width d from the leading end (lower end) in the paper conveyance direction (secondary scanning direction) of the imprinted and stacked paper is defined as a calculation-subject region F1 for counting dots in the image data. The main control unit 10 or the image-processing unit 14 counts the toner dots deposited in the calculation-subject regions F1 on the first side and the second side. For example, in the example illustrated in FIG. 11A, a solid image is provided in the calculation-subject region F1 on the second side, and the calculation-subject region F1 on the second side therefore has a higher dot count.

Thus, since more toner is deposited in the section to be stapled on the second side, curling of the paper toward the second side is predicted. Therefore, in order to remove the curling in the section to be stapled, the decurling unit 9 should be in a state in which the soft roller 92 is in contact with the second side (i.e., the reference position) when paper imprinted on both sides passes through.

Figure 11B:
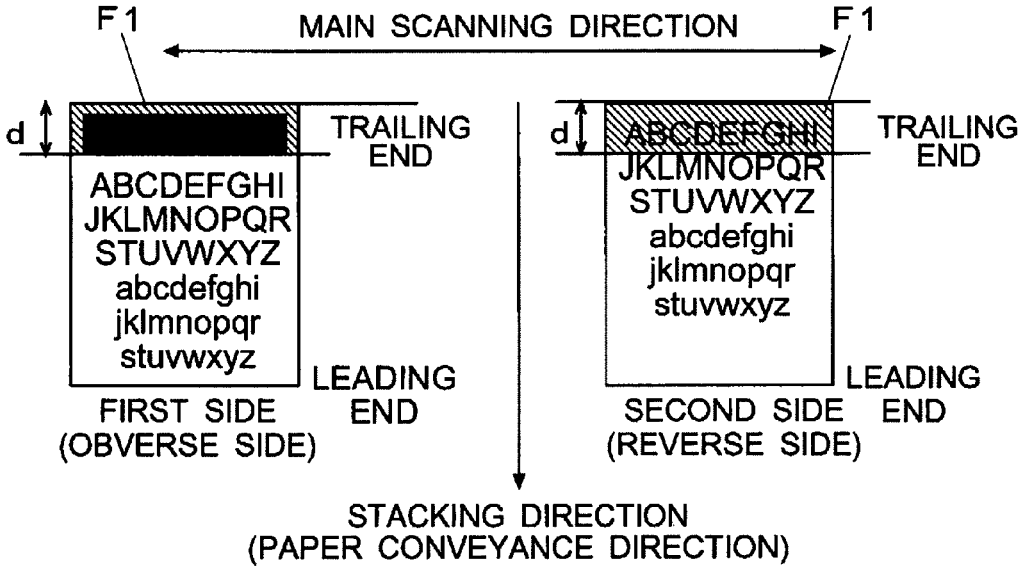
Figure 12:
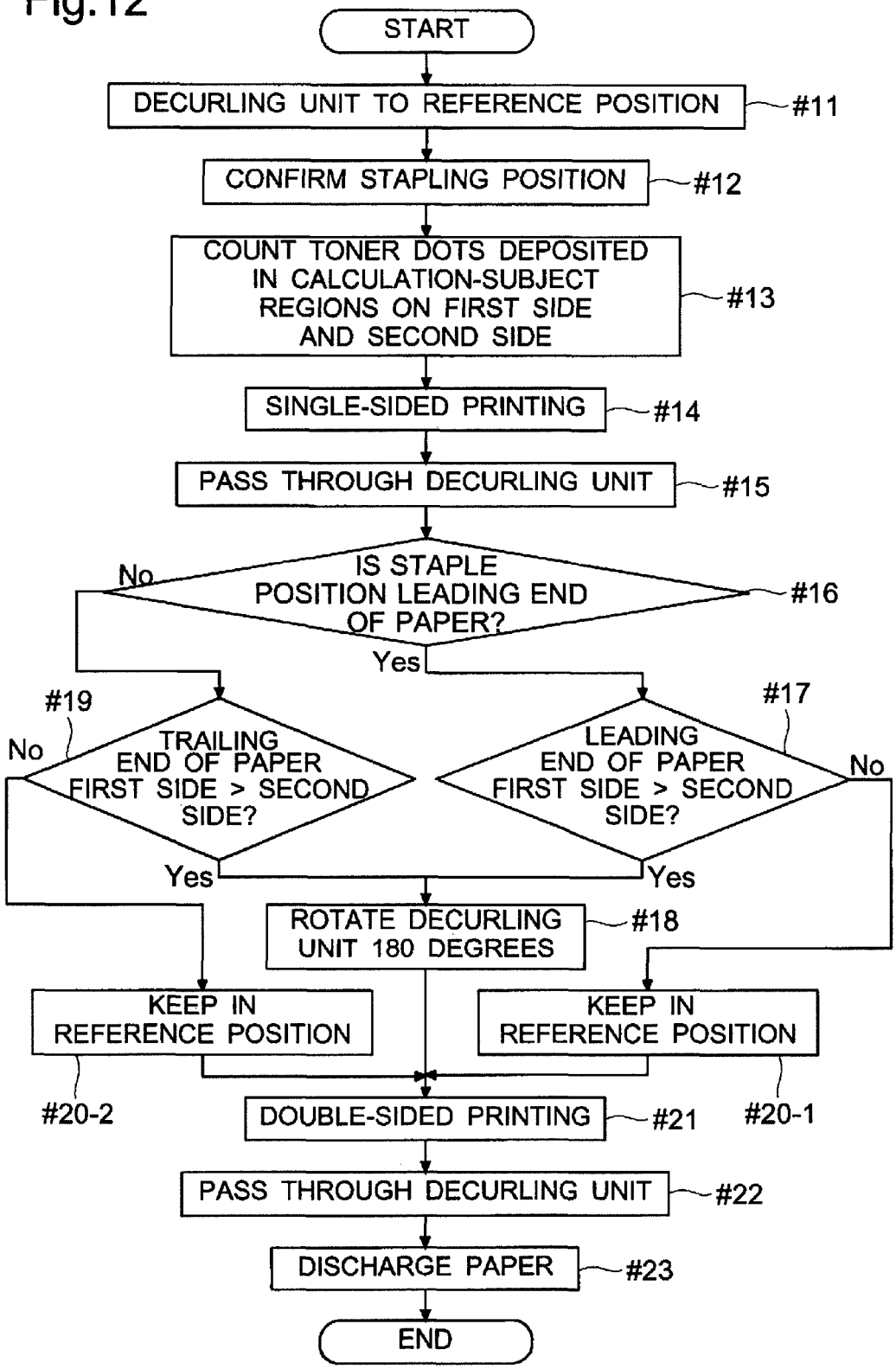
FIG. 12 is a flow chart for describing one example of rotational control of the decurling unit during stapling in the multifunction peripheral of the first embodiment.

On the other hand, FIG. 11B illustrates an example of regions where dots are counted when stapling using the stapling unit 7B on the trailing end side of the paper (the upper side of the stacked paper) in the direction of stacking in the stacking unit 6. The main control unit 10 or the image-processing unit 14 counts the toner dots in the image data on each side, but in this case also, attention is given not to the entirety of the image data, but to a region that is the section where stapling is to be performed.

Specifically, a region of a predetermined width d from the trailing end (upper end) in the paper conveyance direction (secondary scanning direction) of the imprinted and stacked paper is defined as a calculation-subject region F1 for counting dots in the image data. The main control unit 10 or the image-processing unit 14 counts the toner dots deposited in the calculation-subject regions F1 on the first side and the second side. For example, in the example illustrated in FIG. 11B, a solid image is provided in the calculation-subject region F1 on the first side, and the calculation-subject region F1 on the first side therefore has a higher dot count.

Thus, because more toner is deposited in the section to be stapled on the first side, curling of the paper toward the first side is predicted. Therefore, in order to remove the curling in the section to be stapled, the decurling unit 9 should be brought into a state in which the soft roller 92 is in contact with the first side (that is, rotated 180 degrees from the reference position) when paper imprinted on both sides passes through.

The predetermined width d can be set as desired. However, when the predetermined width d is too long, there is little difference from counting the entire region of the image data, and when the predetermined width d is too short, the direction of curling cannot be determined properly. The predetermined width d can therefore be set, for example, from about 30 mm to 100 mm (more preferably, 50 mm). For example, with image data of 600 dpi, where 1 inch equals about 25.4 mm, one dot approximately equals 42.3 μm. Specifically, in the case when the predetermined width d is set as 50 mm at 600 dpi, 50 (mm) divided by 42.3 (μm) approximately equals 1,181. Accordingly, for example, the main control unit 10 or the image-processing unit 14 counts about 1100 to 1200 lines worth extending in the main scanning direction (the direction perpendicular to the paper conveyance direction) from the end of the image data.

An example of rotational control of the decurling unit 9 during double-sided printing with stapling in the multifunction peripheral 100 of the embodiment of the present invention is next described with reference to FIG. 12. The start in FIG. 12 is in the case when an instruction to perform double-sided printing and stapling is given in the multifunction peripheral 100 (in the case when functioning as a copier or a printer).

The main control unit 10 first sets the decurling unit 9 to a reference position just as in FIG. 10 (step #11). The main control unit 10 confirms the settings in the operating panel 1, and confirms the position where stapling is to be performed (step #12). The image-processing unit 14 or the main control unit 10 next counts the respective dots of toner deposited in the calculation-subject regions F1 on the first side and the second side, based on the image data of the first side and the second side to be double-sided printed (step #13). Printing of one side is performed (step #14). The paper passes through the decurling unit 9 (step #15). The main control unit 10 determines that the paper passed through the decurling unit 9, for example, from a passage of time sufficient for the trailing end section of the paper to pass through the decurling unit 9 after passage of the paper is sensed by the paper-sensing sensor S2 provided at the entrance of the fixation unit 4 (sensing of the arrival of paper imprinted on one side by the paper-sensing sensor S1 is also possible).

Next, when the staple position is the leading end of the paper viewed from the direction of stacking (Yes in step #16), the main control unit 10 confirms whether the dot count in the calculation-subject region F1 on the leading end of the paper is higher on the first side than on the second side (step #17). When the dot count is higher on the first side (Yes in step #17), the main control unit 10 operates the case-rotating motor 8 to rotate the decurling unit 9 180 degrees from the reference position (step #18).

On the other hand, when the staple position is the trailing end of the paper viewed from the direction of stacking (No in step #16), the main control unit 10 confirms whether the dot count in the calculation-subject region F1 on the trailing end of the paper is higher on the first side than on the second side (step #19). When the dot count is higher on the first side than on the second side (Yes in step #19), the main control unit 10 operates the case-rotating motor 8 to rotate the decurling unit 9 180 degrees from the reference position (step #18). When the dot count is higher on the second side than on the first side in step #17 and in step #19 (No in step #17, No in step #19), the main control unit 10 keeps the decurling unit 9 in the reference position (steps #20-1, 20-2).

A post-processing device 200 for performing stapling may be attached to an image-forming apparatus (for example, multifunction peripheral 100). In the case when performing stapling, and when there is curling in the section of the paper to be stapled (the section of the paper where the staple points are driven in), the stapling may be done with a part of the paper being shifted in position, or the stapling may be done with a corner of the paper being folded, or the stapling may otherwise not be done properly. The multifunction peripheral 100 is therefore attached with a post-processing device 200 including a stacking unit 6 for receiving imprinted paper and superposing a plurality of sheets of imprinted paper, and a stapling unit 7A and a stapling unit 7B for stapling a paper stack formed by the stacking unit 6. In the case when stapling is performed, a calculation unit (main control unit 10 or image-processing unit 14) performs a calculation to count toner dots deposited in a calculation-subject region F1 including a section to be stapled on the first (obverse) side or the second (reverse) side and representing a region of a predetermined width d from a leading end or trailing end of paper in a secondary scanning direction, and a case-rotating motor 8 (rotation unit) creates a state of contact between a soft roller 92 and a side including the calculation-subject region F1 having the higher dot count or ratio. The curling in the section of the paper fastened by the staple is thereby removed automatically and exactly. Accordingly, the stapling can be accomplished properly.

Specifically, the position for fixing the staple varies according to the position of the stapling unit 7 in the post-processing device 200 or according to the settings for stapling. Therefore, in the case when the stapling unit 7A is used for stapling on the leading end side of the paper, the calculation unit (main control unit 10 or image-processing unit 14) performs a calculation to count toner dots deposited, taking a region of a predetermined width d from the leading end of the paper in the secondary scanning direction as the calculation-subject region F1. In the case when the stapling unit 7B is used for stapling on the trailing end side of the paper, the calculation unit performs a calculation to count toner dots deposited, taking a region of a predetermined width d from the trailing end of the paper in the secondary scanning direction as the calculation-subject region F1. The curling in the section of the paper fastened by the staple is thereby removed automatically and exactly.

After this, double-sided printing is performed on the paper conveyed by switch-backing on the double-sided conveyance path 55 (step #21), the paper imprinted on both sides passes through the decurling unit 9 (step #22), and the paper is discharged to the post-processing device 200 (step #23 to END).

Second Embodiment

Figure 13A:
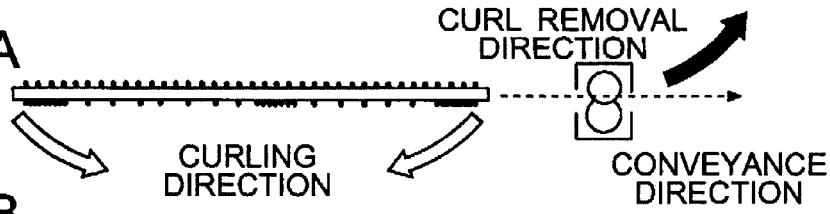
FIGS. 13A and B are diagrams for illustrating the division of regions according to the second embodiment.
Figure 13B:
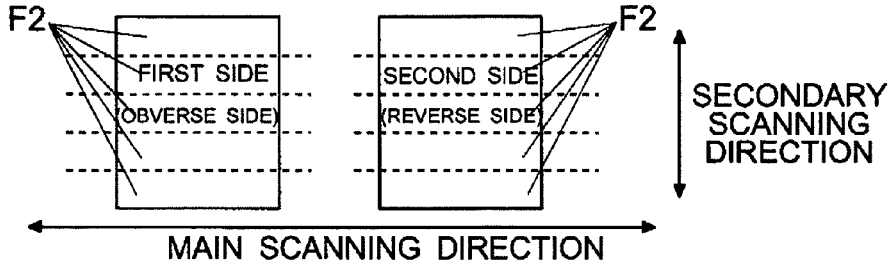
Figure 14:
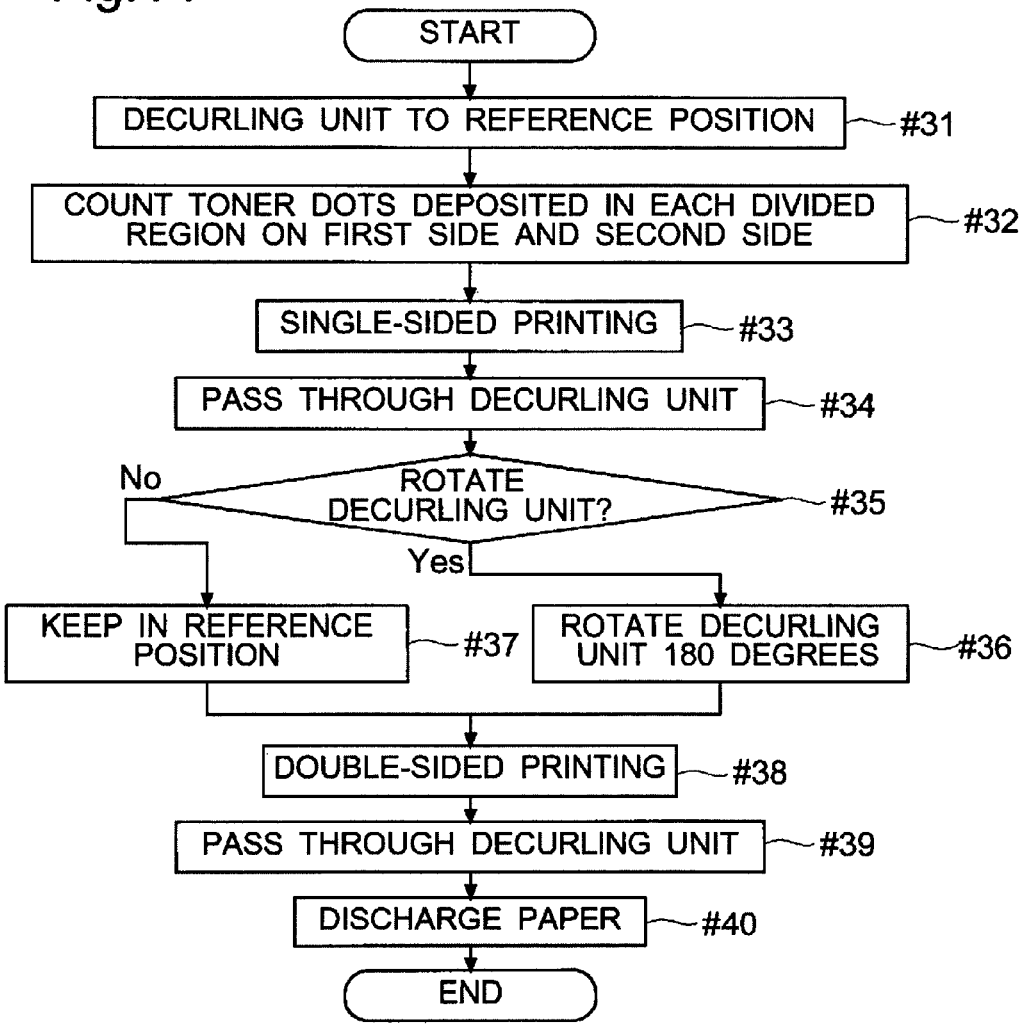
FIG. 14 is a flow chart for describing one example of rotational control of the decurling unit of the second embodiment during double-sided printing.

An example of rotational control of the decurling unit 9 according to a second embodiment of the present invention is next described using FIG. 13 and FIG. 14. FIG. 13A and FIG. 13B are diagrams for describing the division of regions according to the second embodiment. FIG. 14 is a flow chart for describing one example of rotational control of the decurling unit 9 according to the second embodiment of the present invention during double-sided printing.

In the present description, an example of rotational control of the decurling unit 9 in the case when stapling by the stapling unit 7 is not performed in the post-processing device 200 is given.

In the first embodiment, an example in which deposited toner dots were counted across the entire surface of the image data of the first side and the second side, in the case when stapling is not performed, was described. The present embodiment differs in the point that toner dots deposited in each region F2 obtained by dividing the image data of each side into strips are counted to predict the direction of curling of the paper. The other points may be the same as in the first embodiment, a description of the common sections is omitted except in the case when an illustration is being specifically described, and the same symbols are assigned to the common members.

As described using FIG. 9B, in the case of double-sided printing, curling usually occurs more often toward the side of the paper having a larger amount of toner deposited. However, as illustrated in FIG. 13A, even when the same amount of toner is deposited on the first side and the second side, a tendency to curl toward the direction of a side including a section where the concentration of toner (distribution ratio of toner per unit surface area) is high has been confirmed. This is believed to be because local contraction of toner occurs in the section having a high distribution ratio of toner, and the effect on curling is stronger, or an effect is rendered on the amount of evaporation of moisture in the paper.

Therefore, in the present embodiment, as illustrated in FIG. 13B, for each image data of the first side and the second side, the image data is divided into a plurality of strips along the main scanning direction (the direction perpendicular to the paper conveyance direction). The length in the secondary scanning direction (paper conveyance direction) of each divided region F2 should be set, for example, from about 30 mm to 100 mm, and more preferably about 50 mm.

The main controller 10 or the image-processing unit 14 counts the toner dots deposited in each divided region F2. The result of the dot count is higher as the distribution ratio of toner per unit surface area in each region F2 is higher. Accordingly, curling toward a side including a region F2 having the highest count is predicted.

Therefore, an example of rotational control of the decurling unit 9 during double-sided printing in the multifunction peripheral 100 of the second embodiment of the present invention is described with reference to FIG. 14. The start in FIG. 14 is in the case when an instruction to perform double-sided printing is given in the multifunction peripheral 100 (in the case when functioning as a copier or a printer).

The main control unit 10 first operates the case-rotating motor 8 to set the decurling unit 9 to a reference position just as in FIG. 10 (step #31). This point is the same as described using FIG. 10. The image-processing unit 14 or the main control unit 10 counts the toner dots deposited in each region F2, for each region F2 obtained by dividing the image data of the first side and the second side, for performing double-sided printing, into strips (step #32). Printing of one side is performed (step #33). The paper passes through the decurling unit 9 (step #34). The main control unit 10 determines that the paper passed through the decurling unit 9, for example, from a passage of time sufficient for the trailing end section of the paper to pass through the decurling unit 9 after passage of the paper is sensed by the paper-sensing sensor S2 provided at the entrance of the fixation unit 4 (sensing of the arrival of paper imprinted on one side by the paper-sensing sensor S1 is also possible).

The main control unit 10 next confirms whether the decurling unit 9 should be rotated 180 degrees (step #35). Specifically, curling of the paper toward the first side can be predicted when, among regions F2 of image data of the first side and the second side, a region F2 having the highest dot count of toner deposited is included on the first side. The main control unit 10 therefore operates the case-rotating motor 8 to rotate the decurling unit 9 180 degrees from the reference position (YES in step #35 to step #36).

On the other hand, curling of the paper toward the second side can be predicted when a region F2 having the highest dot count of toner deposited is included on the second side, and the main control unit 10 keeps the decurling unit 9 in the reference position (NO in step #35 to step #37). In the present description, all of the regions F2 obtained by dividing the image data of the first side and the second side are taken into account; however, dots may be counted only in the uppermost or lowermost region F2 of the regions F2 on the first side and the second side, and the region F2 having the highest dot count may be selected.

For example, in the case when a solid image is provided in a region F2 being half of the entirety of the first side (obverse side), and in the case when a halftone image having a density of 50% is provided across the entirety of the second side (reverse side), the overall dot count of toner on the side is the same. However, there may be curling toward a side having a higher amount of toner per unit surface area due to the effect of contraction of the toner, or the like, because the distribution density of toner is higher. Therefore, the calculation unit (main control unit 10 or image-processing unit 14) performs a calculation to count toner dots deposited in each region F2 or any region F2 obtained by dividing image data, the data being related to each of the sides including the first side (obverse side) and the second side (reverse side), into a plurality of regions in a secondary scanning direction, and the case-rotating motor 8 (rotation unit) creates a state of contact between the soft roller 92 and a side including a region F2 having the highest dot count. The curling of the paper can thereby be removed automatically and exactly.

After step #36 and step #37, double-sided printing is performed on the paper conveyed by switch-backing on the double-sided conveyance path 55 (step #38), the paper imprinted on both sides passes through the decurling unit 9 (step #39), and the paper is discharged to the post-processing device 200 or the discharge tray 25 inside the body (step #40 to end).

Third Embodiment

Figure 15:
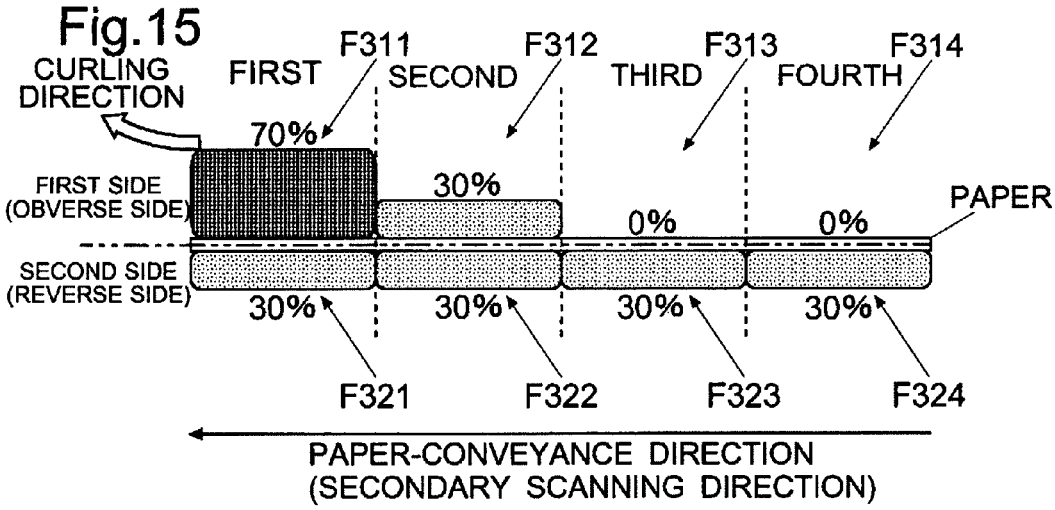
FIG. 15 to FIG. 17 are diagrams for illustrating one example of the method for determining the rotational direction of the decurling unit according to the third embodiment.
Figure 16:
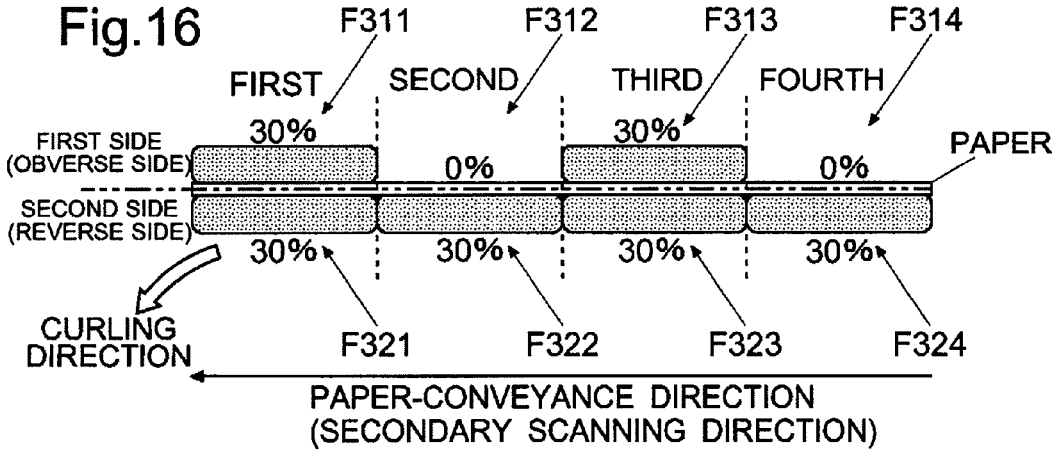
Figure 17:
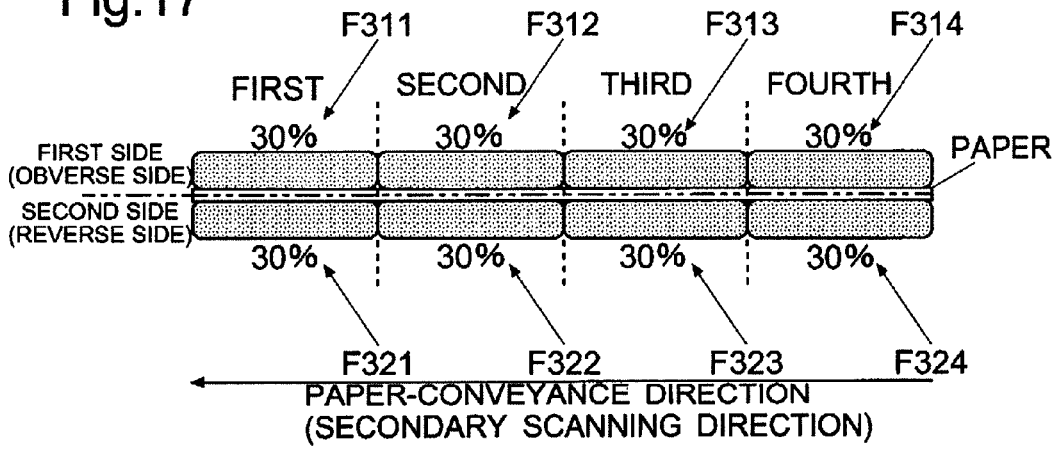
Figure 18:
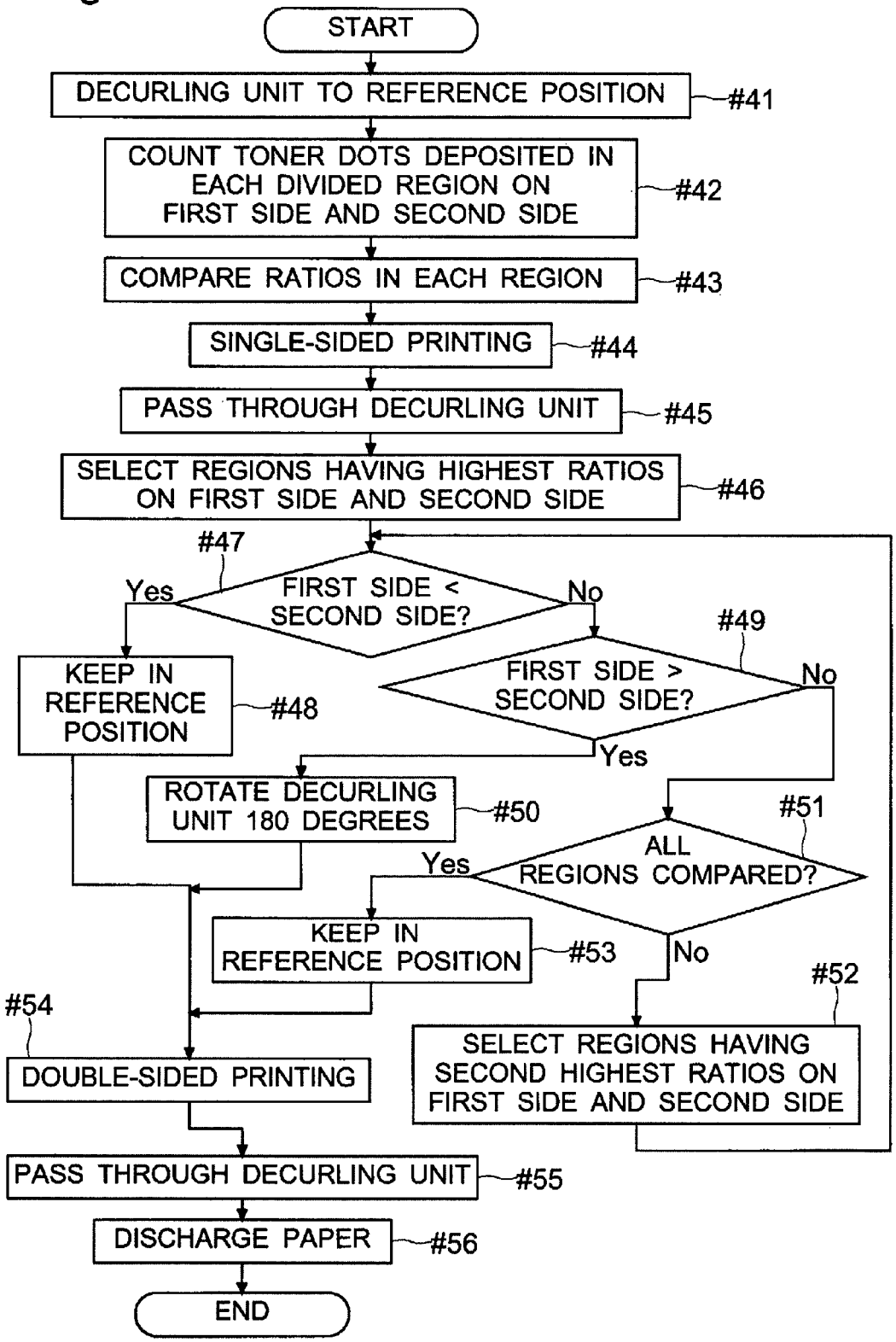
FIG. 18 is a flow chart for describing one example of rotational control of the decurling unit according to the third embodiment during double-sided printing.

An example of rotational control of the decurling unit 9 according to a third embodiment of the present invention is next described using FIG. 15 to FIG. 18. FIG. 15 to FIG. 17 are diagrams for illustrating one example of the method for determining the rotational direction of the decurling unit 9 according to the third embodiment. FIG. 18 is a flow chart for illustrating one example of rotational control of the decurling unit 9 according to the third embodiment of the present invention during double-sided printing.

In the present description, an example of rotational control of the decurling unit 9 in the case when stapling by the stapling unit 7 is not performed in the post-processing device 200 is described.

In the first embodiment, an example in which deposited toner dots were counted across the entire surface of the image data of the first (obverse) side and the second (reverse) side, was described. In the second embodiment, toner dots deposited in each region F2 obtained by dividing the image data of each side into strips are counted to predict the direction of curling of the paper.

The third embodiment is also the same as the second embodiment in the point that the image data of each side is divided into a plurality of strip-form regions, and the toner dots deposited are counted. However, a ratio of deposited toner dots in relation to a total number of dots in each region is obtained. Another difference is in the point that when the compared ratios are (nearly) the same, the regions having the second highest ratio on the first side and the second side are compared, and other regions are compared when those are the same.

In the present embodiment, an example in which the first side of image data is divided nearly equally into four regions F311 to F314 in succession viewed from the paper conveyance direction is described. An example in which the second side of image data is divided nearly equally into four regions F321 to F324 in succession viewed from the paper conveyance direction is also described (see FIG. 15 to FIG. 17). The number of regions on one side may be 5 or more, and may also be divided into 2 or 3. The other points may be the same as in the first and second embodiments, the description of the common sections is omitted except in the case when specifically describing an illustration, and the same symbols are assigned to the common members.

As described using FIG. 13A, there is a tendency to curl toward the direction of a side including a section where the concentration of toner (distribution ratio of toner per unit surface area) is high. In the present embodiment, as illustrated in FIG. 15 to FIG. 17, for each image data of the first side and the second side, the image data is divided into a plurality of strip-form regions (F311 to F314 on the first side, F321 to F324 on the second side) along the main scanning direction (the direction perpendicular to the paper conveyance direction). In other words, for each image data of the first side and the second side, the image data is divided into a plurality of strips in the direction perpendicular to the secondary scanning direction (paper conveyance direction).

The main control unit 10 or the image-processing unit 14 counts the toner dots deposited in each divided region (F311 to F314, F321 to F324), and obtains the ratio of the deposited toner dots in relation to the total number of dots in each region. The ratio is higher as the amount of toner deposited in each region is higher. In other words, the ratio serves as an indicator of the concentration (density) of toner in each region. Because a ratio is obtained, the respective regions do not necessarily have to be of the same size (equal divisions of image data on the first side and the second side)

The main control unit 10 or the image-processing unit 14 selects the region having the highest ratio for each of the first side (obverse side) and the second side (reverse side), compares the ratios, and decides whether to rotate the decurling unit 9 or not. The procedure for decision of the decurling direction by the decurling unit 9 is described with a specific example using FIG. 15 to FIG. 17.

FIG. 15 first illustrates an example in which toner is deposited on the first side (obverse side) at a ratio of 70% in a first region F311, at a ratio of 30% in a second region F312, and at a ratio of 0% in third and fourth regions F313 and F314, and toner is deposited on the second side (reverse side) at a ratio of 30% in each of first to fourth regions F321 to F324.

At this time, the main control unit 10 or the image-processing unit 14 compares the first region F311, being the region having the highest ratio (70%) on the first side, and any one of the regions F321 to F324, being regions having the highest ratio (30%) on the second side. In the case when there is a plurality of regions having the same ratio on the same side, for example, the region at the front in the paper conveyance direction may be set preferentially as the object of comparison. In the case of FIG. 15, because the ratio on the first side is higher, the main control unit 10 or the image-processing unit 14 decides (predicts) that there will be curling toward the first side (the direction of curling is illustrated by the solid-white arrow).

Therefore, in decurling after printing of the second side during double-sided printing, the main control unit 10 rotates the decurling unit 9 180 degrees from the reference position to create a state of contact between the soft roller 92 and the first side. The curling can thereby be removed properly.

FIG. 16 next illustrates an example in which toner is deposited at a ratio of 30% in a first region F311 and a third region F313, and at a ratio of 0% in a second region F312 and a fourth region F314 on the first side (obverse side), and toner is deposited at a ratio of 30% in each of first to fourth regions F321 to F324 on the second side (reverse side).

At this time, the main control unit 10 or the image-processing unit 14 compares the first region F311, being a region having the highest ratio (30%, may also be the third region F313) of the regions (F311 to F314) on the first side, and the first region F321, being a region having the highest ratio (30%, may also be any of the regions F322 to F324) of the regions (F321 to F324) on the second side. In the case of FIG. 16, the ratios are the same on the first side and the second side. The main control unit 10 or the image-processing unit 14 therefore cannot decide the direction of curling.

The main control unit 10 or the image-processing unit 14 next compares regions not yet compared on the first side (obverse side) and the second side (reverse side), being regions having the second highest ratios after the immediately preceding compared regions. For example, the main control unit 10 or the image-processing unit 14 compares the third region F313, being a region not yet compared and having the highest ratio (30%) on the first side, and the second region F322, being a region not yet compared and having the highest ratio (30%, may also be any of the regions F323 and F324) on the second side. However, in the case of FIG. 16, the ratios are the same on the first side and the second side even in the second comparison. The main control unit 10 or the image-processing unit 14 therefore cannot decide the direction of curling.

The main control unit 10 or the image-processing unit 14 therefore compares regions not yet compared on the first side (obverse side) and the second side (reverse side), being regions having the second highest ratios after the immediately preceding compared regions. For example, the main control unit 10 or the image-processing unit 14 compares the second region F312, being a region not yet compared and having the highest ratio (0%, may also be the fourth region F314) on the first side, and the third region F323, being a region not yet compared and having the highest ratio (30%, may also be the region F324) on the second side. At this time, the compared ratio is higher on the second side. The main control unit 10 or the image-processing unit 14 therefore decides (predicts) that there will be curling toward the second side (the direction of curling is illustrated by the solid-white arrow).

Therefore, in decurling after printing of the second side during double-sided printing, the main control unit 10 does not rotate the decurling unit 9 from the reference position to create a state of contact between the soft roller 92 and the second side. The curling can thereby be removed properly.

FIG. 17 next illustrates an example in which toner is deposited at a ratio of 30% in each of first to fourth regions F311 to F314 on the first side (obverse side), and toner is deposited at a ratio of 30% in each of first to fourth regions F321 to F324 on the second side (reverse side).

When there is no difference in ratio, the main control unit 10 or the image-processing unit 14 cannot determine the direction of curling even after the ratios of the regions (F311 to F314) on the first side and the ratios of the regions (F321 to F324) on the second side have been repeatedly compared a number of times equal to the number of divisions of the regions (four in the present embodiment). Such a case may occur when the same kind of content is printed on the first side and the second side. When there is no difference in ratio, the decurling direction may be either, but in the present embodiment, the main control unit 10 does not rotate the decurling unit 9 from the reference position (may also rotate 180 degrees).

An example of rotational control of the decurling unit 9 in the multifunction peripheral 100 of the third embodiment of the present invention during double-sided printing is next described with reference to FIG. 18. The start in FIG. 18 is in the case when an instruction to perform double-sided printing is given in the multifunction peripheral 100 (in the case when functioning as a copier or a printer).

The main control unit 10 first operates the case-rotating motor 8 to set the decurling unit 9 to a reference position just as in FIG. 10 (step #41). This point is the same as described using FIG. 10. The image-processing unit 14 or the main control unit 10 counts the toner dots deposited in each region, for each region obtained by dividing the image data of the first side and the second side, for performing double-sided printing, into strips (step #42). The image-processing unit 14 or the main control unit 10 furthermore obtains a ratio of deposited toner dots in relation to a total number of dots in the region for each region (step #43).

Printing of one side is performed (step #44). The paper passes through the decurling unit 9 (step #45). The main control unit 10 determines that the paper has passed through the decurling unit 9 based on, e.g., the elapsing of a time sufficient for the trailing end section of the paper to pass through the decurling unit 9 after passage of the paper is sensed by the paper-sensing sensor S2 provided at the entrance of the fixation unit 4 (or based on the paper-sensing sensor S1 sensing the arrival of paper imprinted on one side).

The image-processing unit 14 or the main control unit 10 next selects the region having the highest ratio among the regions on each of the first side (obverse side) and the second side (reverse side) (step #46). The image-processing unit 14 or the main control unit 10 checks whether the selected ratio on the second side is higher than the selected ratio on the first side (step #47). In other words, the image-processing unit 14 or the main control unit 10 checks whether the second side includes a region having a higher toner concentration (distribution ratio) than that of the regions on the first side.

When the ratio is higher on the second side (reverse side) (YES in step #47), curling of the paper toward the second side can be predicted, and the main control unit 10 therefore keeps the decurling unit 9 in the reference position (step #48).

When there is a region having a higher ratio, even on a part of the surface, there is often curling of the paper toward the side where the high-ratio region is present because the effect of contraction of the toner is more greatly received. Therefore, the main control unit 10 or the image-processing unit 14 compares the highest ratio of the ratios of each region on the first side (obverse side) and the highest ratio of the ratios of each region on the second side (reverse side), and the rotation unit (case-rotating motor 8) creates a state of contact between the soft roller 92 and the side including the higher ratio. The direction of curling can thereby be decided with consideration given to local disparity of the toner. Accordingly, the direction of curling of the paper can be decided automatically and exactly, and the curling of the paper can be removed exactly.

When the compared ratios are nearly the same (for example, when the difference is merely one to several percentage points), there may be a case when the direction of curling of the paper should not be decided. Therefore, in comparison of ratios, when the difference is within an predetermined allowable range sufficient to consider the ratios as being equal to each other (a difference to the extent of 0.1 to several %), the ratio of the first side and the ratio of the second side may be considered as being equal (hereinafter likewise). In other words, when the difference of ratios is not sufficiently large (for example, 5% or higher), the ratio of the first side and the ratio of the second side may be considered as being equal. For example, when the selected ratio on the second side is 31% and the selected ratio on the first side is 30%, the image-processing unit 14 or the main control unit 10 may decide NO in step #47.

On the other hand, when the ratio is higher on the second side (reverse side) (when first side=second side or first side>second side, NO in step #47), the image-processing unit 14 or the main control unit 10 confirms whether the selected ratio on the first side is higher than the selected ratio on the second side (step #49). When the difference of ratios is within an allowable range sufficient to be considered as being equal even after this confirmation of size, the ratio of the first side and the ratio of the second side may be considered as being equal.

When the ratio is higher on the first side (obverse side) (YES in step #49), curling of the paper toward the first side (obverse side) is predicted, and the main control unit 10 therefore operates the case-rotating motor 8 to rotate the decurling unit 9 180 degrees from the reference position (step #50).

On the other hand, when the ratio is not regarded to be higher on the first side (obverse side) (NO in step #49, when it is the same on the first side and the second side, or is comparable between the first and second sides), the image-processing unit 14 or the main control unit 10(calculation unit) confirms whether the comparison was made for all regions on the first side and the second side (step #51). In other words, the calculation unit confirms whether the selected ratios can be switched (changed). In the present embodiment, the calculation unit confirms whether ratios have already been compared four times.

When all regions have not yet been compared, the image-processing unit 14 or the main control unit 10 selects the region having the second highest ratio after the immediately preceding compared ratio in each region included on the first side (obverse side) and each region included on the second side (reverse side) (step #52). The flow returns to step #47. That is, when the ratios of the regions compared on the first side (obverse side) and the second side (reverse side) are equal to each other or have ratio differences within an predetermined allowable range sufficient to consider the ratios as being equal to each other, the calculation unit (main control unit 10 or image-processing unit 14) compares the ratio of the region having the second highest ratio after the immediately preceding compared region on the first side, and the ratio of the region having the second highest ratio after the immediately preceding compared region on the second side, and the rotation unit (case-rotating motor 8) creates a state of contact between the soft roller 92 and the side including the region having the higher ratio. By this, even when there is no difference in ratio between the compared regions on the first side and the second side and the direction of curling of the paper cannot be determined correctly, the direction of curling of the paper can [subsequently] be decided automatically and exactly, and the curling of the paper can be precisely removed.

On the other hand, when all regions have already been compared (YES in step #51), the direction of curling cannot be decided, and the main control unit 10 therefore keeps the decurling unit 9 in the reference position (step #53). For example, when printing the same kind of image data on both sides of the paper (in an extreme example, printing solid images or images having the same kind of gradation on both sides of the paper), the ratios may not vary between the first (obverse) side and the second (reverse) side, even when the regions are compared. The rotation unit (case-rotating motor 8) therefore does not rotate the decurling unit 9 when the ratios are equal to each other or have ratio differences within an predetermined allowable range sufficient to consider the ratios as being equal to each other even after the ratios of the regions on the first side (obverse side) and the second side (reverse side) have been repeatedly compared a number of times equal to divisions of the regions on the first side (obverse side) or the second side (reverse side). Unnecessary operation of the decurling unit 9 or the rotation unit can thereby be avoided.

After steps #48, 50, and 52, double-sided printing is performed on the paper conveyed by switchbacking on the double-sided conveyance path 55 (step #54), the paper imprinted on both sides passes through the decurling unit 9 (step #55), and the paper is discharged to the post-processing device 200 or the discharge tray 25 inside the body (step #56 to END).

Another embodiment shall now be described. In the first embodiment and the second embodiment, dots are counted and a decision is made as to whether to rotate the decurling unit 9. However, even in the first embodiment and the second embodiment, ratios may be obtained, and the ratios may be compared to decide whether to rotate the decurling unit 9.

In the third embodiment, ratios are obtained and a decision is made as to whether to rotate the decurling unit 9. However, even in the third embodiment, just as in the first embodiment and the second embodiment, dots in each region may be counted, and the counted number of dots may be compared, instead of ratios, to decide whether to rotate the decurling unit 9.

The scope of the present invention is not limited to the embodiments of the present invention described above, and various modifications may be possible within a scope not departing from the substance of the present invention.

What is claimed is:

1. An image-forming apparatus, comprising:

an image-forming unit for forming a toner image transferred to paper, based on image data;

a fixation unit for fixing the toner image transferred to the paper;

a double-sided print conveyance path for connecting a lower path in the paper conveyance direction from the fixation unit and an upper path in the paper conveyance direction from the image-forming unit, and, for during double-sided printing, conveying a paper imprinted on one side toward the image-forming unit;

a decurling unit for passing paper discharged from the fixation unit through a double-roller nip and uncurling the paper, the nip including a hard roller and a soft roller that is softer than the hard roller and is pressed against the hard roller;

a calculation unit for using image data related to respective sides in double-sided printing to calculate an amount of toner deposited on each of a first side, which is the side printed first, and a second side, which is the side on the reverse of the first side and is the side printed next; and a rotation unit for rotating the decurling unit on the basis of calculation results from the calculation unit in order to change a curl removal direction, wherein the calculation unit performs a calculation to count deposited toner dots in respective regions, or any one region, obtained by dividing, in a secondary scanning direction, image data for each of the first and second sides into a plurality of regions, the rotation unit creates a state of contact between the soft roller and a side including a region having a highest dot count or a highest ratio calculated by the calculation unit on the basis of the dot count, the ratio being a highest ratio of deposited toner dots in relation to a total number of dots in the region, the calculation unit compares a highest first ratio from among the ratios of the regions on the first side, and a highest second ratio from among the ratios of the regions on the second side, and the rotation unit creates a state of contact between the soft roller and a side including the region having the higher of the highest first ratio and the highest second ratio.

2. The image-forming apparatus according to claim 1, wherein:

the calculation unit performs a calculation to count, based on image data, toner dots deposited on each of the first and second sides; and the rotation unit brings the decurling unit into a state of contact with the soft roller and a side having a larger number of deposited toner dots on the basis of results from calculating the dot count.

3. The image-forming apparatus according to claim 2, wherein:

the calculation unit performs a calculation to count deposited toner dots on the entire first side and the entire second side.

4. The image-forming apparatus according to claim 1, wherein:

the calculation unit compares a second highest first ratio from among the ratios of the regions on the first side, and a second highest second ratio from among the ratios of the regions on the second side when the highest first and highest second ratios are equal to each other or have a difference within a predetermined allowable range sufficient for the ratios to be regarded as being equal to each other; and the rotation unit creates a state of contact between the soft roller and a side including the region having the higher of the second highest first ratio and the second highest second ratio.

5. The image-forming apparatus according to claim 4, wherein:

the rotation unit does not cause the decurling unit to rotate when all compared ratios between the first side and the second side are equal to each other or have a difference within the predetermined allowable range sufficient to regard the ratios as being equal to each other, the number of compared ratios being a number equal to the number of regions on the first side or the second side.

6. The image-forming apparatus according to claim 1, wherein:

a post-processing device is attached to the image-forming apparatus, the post-processing device having a stacking unit for receiving imprinted paper and stacking a plurality of sheets of the imprinted paper, and a stapling unit for stapling a paper stack formed by the stacking unit; and in a case in which a stapling process is to be performed, the calculation unit performs a calculation to count deposited toner dots in a calculation region for which a calculation is to be executed, the calculation region including a section on the first side or the second side where stapling is to be performed and being of a predetermined width in a secondary scanning direction relative to a leading end or a trailing end of the paper; and the rotation unit creates a state of contact between the soft roller and a side with the calculation region having the higher dot count, or having a higher ratio calculated by the calculation unit on the basis of the dot count, the ratio being a ratio of deposited toner dots in relation to a total number of dots in the calculation region.

7. The image-forming apparatus according to claim 6, wherein:

when the stapling unit is to staple the paper at the leading end, the calculation unit counts deposited toner dots, using a region of a predetermined width in a secondary scanning direction relative to the leading end of the paper as the calculation region.

8. The image-forming apparatus according to claim 6, wherein:

when the stapling unit is to staple the paper at the trailing end, the calculation unit counts deposited toner dots, using a region of a predetermined width in a secondary scanning direction relative to the trailing end of the paper as the calculation region.

9. The image-forming apparatus according to claim 1, wherein:

a state of contact between the soft roller and a printing surface during single-sided printing is used as a reference position for the decurling unit.

10. A method for controlling an image-forming apparatus, comprising the steps of:

forming a toner image to be transferred to paper on the basis of image data;

fixing the toner image transferred to the paper;

conveying the paper imprinted on one side toward an image-forming unit for double-sided printing;

passing the paper through a decurling unit for removing curling from the paper, the unit including a hard roller and a soft roller softer than the hard roller and in contact with the hard roller;

using image data related to respective sides in double-sided printing to calculate an amount of toner deposited on each of a first side, which is the side printed first, and a second side, which is the side on the reverse of the first side and is the side printed next; and rotating the decurling unit on the basis of calculation results, said method further comprising the steps of:

performing a calculation for counting deposited toner dots in respective regions, or any one region, obtained by dividing, in a secondary scanning direction, image data for each of the first and second sides into a plurality of regions;

creating a state of contact between the soft roller and a side including a region having a highest dot count or a highest ratio based on the dot count, the ratio being a highest ratio of deposited toner dots in relation to a total number of dots in the region;

comparing a highest first ratio from among the ratios of the regions on the first side, and a highest second ratio from among the ratios of the regions on the second side; and creating a state of contact between the soft roller and a side including the region having the higher of the highest first ratio and the highest second ratio.

11. The method for controlling an image-forming apparatus according to claim 10, comprising the steps of:

performing a calculation to count, based on image data, deposited toner dots on each of the first and second sides; and bringing the decurling unit into a state of contact with the soft roller and a side having a larger number of deposited toner dots on the basis of results of calculating the dot count.

12. The method for controlling an image-forming apparatus according to claim 11, comprising the step of:

performing a calculation for counting deposited toner dots on an entirety of the first side and an entirety of the second side.

13. The method for controlling an image-forming apparatus according to claim 10, comprising the steps of:

comparing a second highest first ratio from among the ratios of the regions on the first side, and a second highest second ratio from among the ratios of the regions on the second side when the highest first and highest second ratios are equal to each other or have a difference within a predetermined allowable range sufficient for the ratios to be regarded as being equal to each other; and creating a state of contact between the soft roller and a side including the region having the higher of the second highest first ratio and the second highest second ratio.

14. The method for controlling an image-forming apparatus according to claim 13, comprising the step of:

not causing the decurling unit to rotate when all compared ratios between the first side and the second side are equal to each other or have a difference within the predetermined allowable range sufficient for the ratios to be regarded as being equal to each other, the number of compared ratios being a number equal to the number of regions on the first side or the second side.

15. The method for controlling an image-forming apparatus according to claim 10, comprising the steps of:

providing the image-forming apparatus with a post-processing device including a stapling unit for stapling a paper stack, and, when stapling is to be performed, performing a calculation for counting deposited toner dots in a calculation region for which a calculation is to be executed, the calculation region including a section on the first side or the second side where stapling is to be performed and being of predetermined width in a secondary scanning direction relative to a leading end or a trailing end of the paper; and creating a state of contact between the soft roller and a side with the calculation region having the higher dot count or having a higher ratio calculated by the calculation unit on the basis of the dot count, the ratio being a ratio of deposited toner dots in relation to a total number of dots in the calculation region.

16. The method for controlling an image-forming apparatus according to claim 15, comprising the steps of:

when the stapling unit is to staple the paper at the leading end, counting deposited toner dots, using a region of a predetermined width in a secondary scanning direction relative to the leading end of the paper as the calculation region; and when the stapling unit is to staple the paper at the trailing end, counting deposited toner dots, using a region of a predetermined width in a secondary scanning direction relative to the trailing end of the paper as the calculation region.

* * * * *